US006448212B1

(12) United States Patent
Holderbaum et al.

(10) Patent No.: US 6,448,212 B1
(45) Date of Patent: Sep. 10, 2002

(54) LAUNDRY/DISHWASHER DETERGENT PORTION

(75) Inventors: Thomas Holderbaum, Monheim; Bernd Richter, Leichlingen; Christian Nitsch, Duesseldorf; Juergen Haerer, Duesseldorf, all of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

(21) Appl. No.: 09/611,858

(22) Filed: Jul. 7, 2000

(30) Foreign Application Priority Data

Jul. 9, 1999 (DE) ..... 199 32 205

(51) Int. Cl.[7] ..... C11D 17/08

(52) U.S. Cl. ..... 510/296; 510/295; 510/298; 510/276; 510/220; 510/224; 510/235; 510/446

(58) Field of Search ..... 510/296, 295, 510/298, 276, 220, 224, 235, 446

(56) References Cited

U.S. PATENT DOCUMENTS

| | | | | |
|---|---|---|---|---|
| 3,158,615 A | | 11/1964 | Dunn et al. | 260/290 |
| 3,234,258 A | | 2/1966 | Morris | 260/460 |
| 4,524,009 A | | 6/1985 | Valenty | 252/89.1 |
| 4,608,187 A | * | 8/1986 | Chang | 252/90 |
| 4,626,372 A | * | 12/1986 | Kaufmann et al. | 252/90 |
| 4,639,325 A | | 1/1987 | Valenty et al. | 252/89.1 |
| 4,664,839 A | | 5/1987 | Rieck et al. | 252/175 |
| 4,816,553 A | | 3/1989 | Baur et al. | 528/245 |
| 4,820,439 A | | 4/1989 | Rieck et al. | 252/135 |
| 4,973,416 A | * | 11/1990 | Kennedy | 252/90 |
| 4,985,553 A | | 1/1991 | Fuertes et al. | 536/124 |
| 5,075,041 A | | 12/1991 | Lutz | 252/548 |
| 5,133,892 A | * | 7/1992 | Chun et al. | 252/90 |
| 5,135,982 A | * | 8/1992 | Matsumoto et al. | 525/61 |
| 5,356,607 A | | 10/1994 | Just | 423/334 |
| 5,417,951 A | | 5/1995 | Just | 423/334 |
| 5,453,216 A | * | 9/1995 | Kellett | 252/174.13 |
| 5,494,488 A | | 2/1996 | Arnoldi et al. | 8/137 |
| 5,501,814 A | | 3/1996 | Engelskirchen et al. | 252/174.17 |
| 5,541,316 A | | 7/1996 | Engelskirchen et al. | 510/471 |
| 5,580,941 A | | 12/1996 | Krause et al. | 527/300 |
| 5,780,420 A | | 7/1998 | Breuer et al. | 510/466 |
| 5,783,616 A | | 7/1998 | Krause et al. | 524/58 |
| 5,821,360 A | | 10/1998 | Engelskirchen et al. | 536/124 |
| 5,830,956 A | | 11/1998 | Stockhausen et al. | 526/318.2 |
| 5,847,065 A | | 12/1998 | Krause et al. | 527/300 |
| 5,854,191 A | | 12/1998 | Krause et al. | 510/276 |
| 5,854,321 A | | 12/1998 | Krause et al. | 524/58 |

FOREIGN PATENT DOCUMENTS

| | | |
|---|---|---|
| DE | 1 130 547 | 5/1962 |
| DE | 42 21 381 | 2/1994 |
| DE | 43 00 772 | 7/1994 |
| DE | 44 00 024 | 7/1995 |
| DE | 44 17 734 | 11/1995 |
| DE | 42 03 320 | 12/1995 |
| DE | 195 40 086 | 4/1997 |
| DE | 196 00 018 | 7/1997 |
| DE | 199 29 098.9 | 6/1999 |
| EP | 0 143 476 | 6/1985 |
| EP | 0 150 930 | 8/1985 |
| EP | 0 158 464 | 10/1985 |
| EP | 0 232 202 | 8/1987 |
| EP | 0 280 223 | 8/1988 |
| EP | 0 427 349 | 5/1991 |
| EP | 0 472 042 | 2/1992 |
| EP | 0 542 496 | 5/1993 |
| EP | 0 164 514 | 12/1995 |
| EP | 94 16 091 | 3/1996 |
| EP | 0 727 448 | 8/1996 |
| JP | 58/217598 | 12/1983 |
| JP | 5/339896 | 12/1993 |
| WO | WO90/13533 | 4/1989 |
| WO | WO91/08171 | 6/1991 |
| WO | WO92/18542 | 10/1992 |
| WO | WO93/08251 | 4/1993 |
| WO | WO93/16110 | 8/1993 |
| WO | WO94/28030 | 12/1994 |
| WO | WO95/07303 | 3/1995 |
| WO | WO95/07331 | 3/1995 |
| WO | WO95/12619 | 5/1995 |
| WO | WO95/20029 | 7/1995 |
| WO | WO95/20608 | 8/1995 |

* cited by examiner

*Primary Examiner*—Charles Boyer
(74) *Attorney, Agent, or Firm*—Stephen D. Harper; Glenn E. J. Murphy

(57) ABSTRACT

The invention relates to a laundry/dishwasher detergent portion, more particularly for use in a washing/dishwashing machine for a program taking place in an aqueous phase, containing (a) a first measured quantity of a washing preparation which passes into the aqueous phase at a temperature below or equal to a first temperature;

(b) a second measured quantity of a washing preparation which passes into the aqueous phase at a temperature below or equal to a second temperature which is above the first temperature;

(c) at least one material which surrounds at least one of the measured quantities of a washing preparation and which dissolves in water at a certain temperature. The invention also relates to a process for the production of such a laundry/dishwasher detergent portion and to a washing process and a cleaning process using the laundry/dishwasher detergent portion.

61 Claims, No Drawings

LAUNDRY/DISHWASHER DETERGENT PORTION

BACKGROUND OF THE INVENTION

This invention relates to a laundry/dishwasher detergent portion with a wrapper of a water-soluble material. More particularly, the invention relates to a laundry/dishwasher detergent portion for use in a washing/dishwashing machine for a machine program taking place in an aqueous phase.

Various laundry/dishwasher detergent formulations available to the consumer in the form of spray-dried or granulated powder products or, alternatively, as liquid products are known from the prior art. These detergent formulations are introduced into the dispensing compartments of washing or dishwashing machines by the consumer using standard containers supplied with the detergents or, particularly in the washing of laundry, into water-permeable containers supplied with the detergents, i.e. containers through which the wash liquor is able to flow. The dosing process has often found to be laborious.

In order to make laundry/dishwasher detergent formulations easier to dose, formulations packed in the form of ready-to-use portions of a laundry/dishwasher detergent sufficient for exactly one wash cycle have been developed. Corresponding portions may be both solid and liquid laundry/dishwasher detergent formulations. Solid laundry/dishwasher detergent formulations may be present in the form of powders or shaped bodies (for example obtained by compression), such as tablets, blocks, briquettes or rings or the like.

Individual doses of laundry/dishwasher detergent formulations have been suitably packaged or wrapped to protect the ingredients of the laundry/detergent formulations against moisture in an environment which, of course, is not normally kept dry and also for protecting the consumer from the ingredients of the formulation, more particularly for protecting people not accustomed to using such formulations. According to the prior art, the packs or wrappers may consist of plastic films of which the properties can be controlled to meet requirements.

Even in the prior art, advanced packs and wrappers, more particularly plastic films, which met the above requirements were soluble in water. The consumer was thus able directly to introduce the portion pack into the wash cycle or to throw it into a bucket or bowl without having to deposit or pour out its contents at an appropriate place. The pack or wrapper then dissolved during the washing/dishwashing process or before or during the hand washing/cleaning process so that its contents came into contact with the aqueous medium.

Thus, DE-AS 11 30 547 (Procter & Gamble) discloses packs of water-soluble films of polyvinyl alcohol which are filled with non-liquid synthetic detergents.

An individual dose of a detergent or bleach in a bag having one or more seams of a water-sensitive material is described in EP-A 0 143 476 (Akzo N. V.). The water-sensitive seam material used is a mixture of an anionic and/or nonionic water-binding polymer and a cationic adhesive.

EP-A 0 158 464 (Clorox) describes low-temperature detergents which may be packed in a bag of water-soluble film.

Accordingly, the prior-art documents cited above describe laundry/dishwasher detergents in a water-soluble pack which dissolves completely on contact with water and releases its contents into the wash liquor. They do not disclose the step-by-step release of various ingredients of the laundry/dishwasher detergent present in the pack.

In contrast to the prior art, the object of the present invention was to take account of the fact that individual components of a laundry/dishwasher detergent preparation may not be compatible with other components of the same preparation or that one component of a laundry/dishwasher detergent preparation may be needed or desirable in one particular wash or cleaning cycle, but not in another or that a certain component of a laundry/dishwasher detergent preparation may not have the same effectiveness at all the temperatures of a wash or cleaning cycle and, in order to ensure that the liquor develops an optimal effect, should be added at a temperature which corresponds to the action optimum. This applies, for example, to enzymes which regularly develop optimal activity at a certain temperature or to bleach activators which are incorporated in a laundry/dishwasher detergent preparation in order to obtain an improved bleaching effect where washing/dishwashing is carried out at temperatures of 60° C. or lower. In the same way, the presence of fabric softeners during washing or rinse aids during dishwashing is only desirable in a softening or clear-rinse cycle following the actual washing/cleaning cycle. Accordingly, components such as these are normally not added to the laundry/dishwasher detergent formulation or portion which is used in a prewash, prerinse or main wash cycle. The problem addressed by the present invention was effectively to separate components or groups of components of a laundry/dishwasher detergent portion in such a way that the individual components would not impair one another in their effectiveness and/or stability and, in the case of an automatic wash cycle consisting of several steps with separate wash liquors, the individual components or groups of individual components adapted to the wash cycle would be released into the liquor in that step in which they develop optimal activity. Another problem addressed by the present invention was to enable the conditions under which the individual components or groups of components of a laundry/dishwasher detergent portion are released into the wash liquor to be controlled by physical measures of the washing or dishwashing cycle.

It has now surprisingly been found that a so-called controlled-release effect can be achieved and components of a laundry/dishwasher detergent portion can be released into the wash liquor at precisely controllable times of a washing or cleaning cycle so that an optimal washing or cleaning result can be obtained if the laundry/dishwasher detergent portion contains a material which surrounds at least one of the measured quantities of a washing preparation and which dissolves in water at a certain temperature.

DESCRIPTION OF THE INVENTION

Accordingly, the present invention relates to a laundry/dishwasher detergent portion, more particularly for use in a washing/dishwashing machine for a program taking place in an aqueous phase, containing

- a first measured quantity of a washing preparation which passes into the aqueous phase at a temperature below or equal to a first temperature;
- a second measured quantity of a washing preparation which passes into the aqueous phase at a temperature below or equal to a second temperature which is above the first temperature;
- at least one material which surrounds at least one of the measured quantities of a washing preparation and which dissolves in water at a certain temperature.

In one preferred embodiment of the detergent portion according to the invention, at least the second measured quantity of a washing preparation is surrounded by a material which dissolves in water at a temperature above the first temperature.

The invention also relates to a process for the production of laundry/dishwasher detergent portions comprising first and second measured quantities of washing preparations as described hereinafter comprising the steps of (a) making ready at least one material which dissolves in water at a certain temperature and (b) wrapping at least one of the first and second measured quantities of washing preparations in this material to form a laundry/dishwasher detergent portion.

According to the invention, a preferred process for the production of laundry/dishwasher detergent portions comprising first and second measured quantities of washing preparations is characterized in that it comprises the steps of (a) making ready at least one material which dissolves in water at a temperature above a first temperature;

(b) wrapping the measured quantity of a second washing preparation active in aqueous phase at a temperature above the first temperature in that material and (c) combining a measured quantity of a first washing preparation and optionally a measured quantity of a third washing preparation with the laundry/dishwasher detergent part-portion produced in step (b) to form a laundry/dishwasher detergent portion.

The invention also relates to a washing process, more particularly a machine washing process, wherein the laundry detergent portion described above and in more detail hereinafter is placed in a washing machine or in a vessel suitable for washing and the laundry detergent part-portion is released into the wash liquor by addition of water and adjustment of the temperature to the temperature at which the water-soluble material surrounding the particular laundry detergent part-portion dissolves while the other laundry detergent part-portions are protected against contact with the wash liquor and are released at other temperatures.

The invention also relates to a cleaning process, more particularly a machine dishwashing process, wherein the dishwasher detergent portion described above and in more detail hereinafter is placed in a dishwashing machine or in a vessel suitable for washing dishes and the dishwasher detergent part-portion is released into the wash liquor by addition of water and adjustment of the temperature to the temperature at which the water-soluble material surrounding the particular dishwasher detergent part-portion dissolves while the other dishwasher detergent part-portions are protected against contact with the wash liquor and are released at other temperatures.

A "detergent portion" in the context of the present invention is understood to be a dose of a laundry or dishwashing detergent which is sufficient for a washing or cleaning process taking place in an aqueous phase. This may be, for example, a machine washing or dishwashing process carried out in commercially available washing or dishwashing machines. However, the expression "detergent portion" is also understood to encompass handwashing (carried out for example in a handwashing basin or in a bowl) or manual dishwashing or any other washing or cleaning process. According to the invention, the detergent portions are preferably used in machine washing or cleaning processes.

A "detergent part-portion" in the context of the invention is understood to be part of a detergent portion which is present in a phase separated from other detergent part-portions in spatial combination with other detergent part-portions of the same detergent portion and which is prepared by suitable measures in such a way that it can be introduced into the wash liquor separately from other part-portions of the same detergent portion and dissolved or suspended therein. A detergent part-portion can contain the same ingredients as part-portion of the same detergent portion. However, two part-portions of the same detergent portion preferably contain different ingredients, more particularly different washing preparations.

According to the invention, the detergent portions contain measured quantities of washing preparations. The detergent portions may only contain washing preparations having a particular composition. According to the invention, however, several, normally at least two, washing preparations differing in their composition are preferably present in the detergent portions. The composition may differ both in regard to the concentration of the individual components of the washing preparation (i.e. quantitatively) and/or in regard to the nature of the individual components of the washing preparation (i.e. qualitatively). In one particularly preferred embodiment, the components are adapted in regard to type and concentration to the functions the detergent part-portions are intended to perform in the washing or cleaning cycle. According to the present invention, the part-portions are preferably the first, second and optionally third or even fourth, fifth etc. measured quantities of one or more washing preparations which are wrapped in different water-soluble materials and which are combined to form a detergent portion according to the invention.

In the context of the present invention, "washing preparations" are understood to be preparations of any conceivable substances that are relevant to a washing or cleaning process. These are primarily the actual laundry or dishwashing detergents themselves with their individual components explained in more detail hereinafter. These include such active ingredients as surfactants (anionic, nonionic, cationic and amphoteric surfactants), builders (inorganic and organic builders), bleaching agents (for example peroxo bleaching and chlorine bleaching agents), bleach activators, bleach stabilizers, bleach catalysts, enzymes, special polymers, dyes and perfumes, although the expression "washing preparation" is by no means confined to substances belonging to these groups. However, the expression "washing preparations" is also understood to encompass washing and cleaning aids. Laundry treatment compositions, such as fabric softeners, and dishwasher detergent additives, such as rinse aids, are also regarded as washing preparations in the context of the present invention.

According to the invention, the laundry/dishwasher detergent portion contains at least a first measured quantity of a washing preparation which passes into the aqueous phase at a temperature below or equal to a first temperature;

a second measured quantity of a washing preparation which passes into the aqueous phase at a temperature below or equal to a second temperature which is above the first temperature;

at least one material which surrounds at least one of the measured quantities of a washing preparation and which dissolves in water at a certain temperature.

In one preferred embodiment of the laundry/dishwasher detergent portion according to the invention, at least the second measured quantity of a washing preparation is surrounded by a material which dissolves in water at a temperature above the first temperature.

In another preferred embodiment of the invention, the first washing preparation which is present in a measured quantity in the laundry/dishwasher detergent portion is a composition suitable for the prewash cycle or "pre-cleaning" cycle, more particularly for the pre-rinse cycle, while the second washing preparation which is present in a measured quantity in the laundry/dishwasher detergent portion is a composition suitable for the main wash cycle or main cleaning cycle, more particularly for the main wash cycle. The first washing preparation passes into the aqueous phase at a temperature below or equal to a first temperature while the second washing preparation passes into the aqueous phase at a temperature below or equal to a second temperature which is above the first temperature.

At least the second washing preparation, i.e. in this case the washing preparation adapted for the main wash cycle, is surrounded by a suitable water-soluble material. The properties of this material must be such that it surrounds the second washing preparation during the prewash or prerinse cycle, i.e. protects it against the entry of water or wash liquor and hence against any deterioration in effectiveness and/or against any reduction of the effective quantity. According to the invention, this is achieved by virtue of the fact that the water-soluble material surrounding the second washing preparation only dissolves in water at a temperature which is above the temperature of the prewash or prerinse cycle. Accordingly, the (second) water-soluble material surrounding the second washing preparation remains intact during the prewash or prerinse cycle which is normally carried out at a low temperature, usually with cold water. Accordingly, the second washing preparation is protected against the entry of water or aqueous liquor and thus remains fully intact and fully effective for the main wash cycle.

In another preferred embodiment of the invention, the first measured quantity of a washing preparation is conveniently dosed and ready to use for the prewash or prerinse cycle in the laundry/dishwasher detergent portion according to the invention and, in addition, is protected against contact by unauthorized users or by the consumer and also against the entry of moisture by the fact that it is surrounded by a water-soluble material which enables the first measured quantity of a washing preparation to pass into the aqueous phase or liquor at a temperature below or equal to a first temperature. The material surrounding the first measured quantity of a washing preparation affords the major advantage that the laundry/dishwasher detergent portion is sufficient for one wash cycle, more particularly in a washing or dishwashing machine, and not only are all the components required for the washing/dishwashing cycle combined in a single unit to be placed in the machine, the washing components are also present in an optimum ratio to one another and in a manner in which they are released into the wash liquor at a time during the wash cycle at which they are also able to develop optimal activity. In one particularly preferred embodiment, the water-soluble material surrounding the first measured quantity of a washing preparation has a solubility in water which enables the washing preparation to pass into the aqueous phase or liquor at the temperatures at which the first cycle of the washing/dishwashing program in which this washing preparation is intended to develop its effectiveness is carried out. In the present case, the first cycle in question is the prewash or prerinse cycle. In the (general) case where this cycle is carried out at cold water temperatures, for example at most ambient temperature, for example at 3 to 25° C., preferably at 5 to 20° C., more preferably at 7 to 18° C. and most preferably at 15 to 18° C., the water-soluble material surrounding the first measured quantity of a washing preparation is soluble in water at the temperatures mentioned, i.e. at most ambient temperature, for example 15 to 18° C. In general, the solubility of this material should be adjusted in such a way that it dissolves reliably at the maximum temperature of the cold water phase of a washing/dishwashing program.

In another preferred embodiment of the invention, the first washing preparation present in a measured quantity in the laundry/dishwasher portion is a composition suitable for the prewash or "pre-cleaning" cycle, more particularly for the pre-rinse cycle, the second washing preparation present in a measured quantity in the laundry/dishwasher detergent portion is a composition suitable for the main wash or main cleaning cycle, more particularly for the main wash cycle, and a third washing preparation also present in a measured quantity in the laundry/dishwasher detergent portion is a composition suitable for the final wash cycle or clear-rinse cycle. The first washing preparation passes into the aqueous phase at a temperature below or equal to a first temperature, the second washing preparation passes into the aqueous phase at a temperature below or equal to a second temperature which is above the first temperature and the third washing preparation passes into the aqueous phase at a temperature which is above the second temperature.

In this case, too, at least the second washing preparation, i.e. in this case the washing preparation adapted for the main wash cycle, is surrounded by a suitable water-soluble material. The properties of this material resemble the case described above where the laundry/dishwasher detergent portion according to the invention consists of only two washing preparations for the prewash or prerinse cycle and for the main wash cycle. In this case, too, the first measured quantity of a washing preparation is preferably surrounded by a material which dissolves in water at low temperatures because this ensures a convenient and ready-to-use dosage of the washing preparations in the detergent portion according to the invention and protects the first measured quantity of a washing preparation against direct contact by the consumer or even by an unauthorized user, for example against contact or swallowing by children, before the laundry/dishwasher detergent portion according to the invention is introduced into the washing/dishwashing cycle and also ensures that the individual components of the first measured quantity of a washing preparation are protected against deterioration under environmental conditions (for example moisture) and/or against any reduction in the effective quantity.

In another preferred embodiment of the invention, the laundry/dishwasher detergent portion contains a third measured quantity of a washing preparation which is also surrounded by a suitable water-soluble material to protect it from passing into the wash liquor at a temperature at which the main wash cycle is still taking place. The properties of this material are preferably such that it surrounds the third washing preparation during the pre-wash cycle or pre-rinse cycle and during the main wash cycle, i.e. protects it against the entry of water or wash liquor and hence against any deterioration in effectiveness and/or any reduction in the effective quantity. According to the invention, this is achieved by the fact that the water-soluble material surrounding the third washing preparation only dissolves in water at a temperature which is above the temperature of the main wash cycle. Accordingly, the (third) water-soluble material surrounding the third washing preparation remains intact during the pre-wash or pre-rinse cycle normally carried out at low temperatures, usually with cold water, and during the main wash cycle which is normally carried out at medium temperatures, preferably at >20 to 55° C. and more preferably at >25 to below about 45° C., for example at >30 to 45° C. The third washing material is thus protected against the entry of water or aqueous liquor and remains fully available and fully effective for the final wash cycle (for example softening cycle) or clear-rinse cycle.

In another preferred embodiment of the invention, the first washing preparation present in a measured quantity in the laundry/dishwasher detergent portion is a composition suitable for the main wash or main cleaning cycle, more particularly for the main wash cycle, while a second washing preparation which is also present in a measured quantity in the laundry/dishwasher detergent portion is a composition suitable for the final wash cycle or clear-rinse cycle. The first washing preparation passes into the aqueous phase at a temperature below or equal to a first temperature which, in the present case, is the temperature of the main wash cycle, for example at a temperature of or below 45° C. and preferably at a temperature of or below 30° C., while the second washing preparation passes into the aqueous phase at a temperature which is above the first temperature, i.e. at the temperature of the final wash cycle or clear-rinse cycle, for example at a temperature above 45° C. and preferably at a temperature of 50 to 55° C.

In this case, too, at least the second washing preparation, i.e. in this case the washing preparation adapted for the final wash or softening cycle or the clear-rinse cycle, is surrounded by a suitable water-soluble material. The properties of this material must be such that it surrounds the second washing preparation during the main wash cycle, i.e. protects against the entry of water or wash liquor and hence against any deterioration in effectiveness and/or any reduction in the effective quantity. According to the invention, this is achieved by the fact that the water-soluble material surrounding the second washing preparation only dissolves in water at a temperature above the temperature of the main wash cycle. Accordingly, the (second) water-soluble material surrounding the second washing preparation remains intact during the main wash cycle which is normally carried out at relatively low temperature, usually with water having a temperature of 25 to 45° C. The second washing preparation is thus protected against the entry of water or aqueous liquor and, accordingly, remains fully available and fully effective for the final wash or clear-rinse cycle.

In this case, too, the first measured quantity of a washing preparation is preferably surrounded by a material which dissolves in water at relatively low temperatures, i.e. at the temperature of the main wash cycle, because this ensures a convenient and easy-to-use dosage of the washing preparations in the laundry/dishwasher detergent portion according to the invention and protects the first measured quantity of a washing preparation against direct contact by the consumer or even by an unauthorized user, for example against contact or swallowing by children, before the laundry/dishwasher detergent portion according to the invention is introduced into the wash cycle and also ensures that the individual components of the first measured quantity of a washing preparation (intended in this case for the main wash cycle) are protected against deterioration under environmental conditions (for example moisture) and/or against any reduction in the effective quantity.

In another preferred embodiment of the invention, first and second measured quantities and optionally further (for example third) measured quantities of a washing preparation present in a detergent portion according to the invention are compositions suitable and intended for the main wash cycle while a further measured quantity (for example third or optionally fourth measured quantities) of a washing preparation in the laundry/dishwashing detergent portion is a composition suitable and intended for the final wash or clear-rinse cycle. The first, second and optionally third compositions intended for the main wash cycle pass into the aqueous phase successively, shortly after one another or even partly at the same time and partly successively at a temperature situated at different points of the temperature profile of the main wash cycle while the further (third or optionally fourth) measured quantity of a washing preparation only passes into the aqueous phase at a temperature which is above the temperatures mentioned above, for example at the temperature of the final rinse cycle.

At least one of the measured quantities of washing preparations is surrounded by a material which dissolves in water at a certain temperature. In a preferred embodiment, several of the measured quantities of washing preparations are surrounded by one or more water-soluble material(s). The solubility(ies) of the water-soluble material(s) in water are adjusted according to which washing preparation is to be released into the liquor either on its own or even in conjunction with another washing preparation at a certain stage of the main wash or main cleaning cycle. In another preferred embodiment, this is achieved by adjusting the solubility of one or more of the water-soluble materials in water to fixed temperatures differing from one another in the profile of the main wash or cleaning cycle. The material dissolving in water at the lowest temperature dissolves at a relatively low temperature of the main wash or cleaning cycle which lies at the beginning of the temperature profile and releases the washing preparation surrounded by that material into the washing liquor. Providing the water solubility temperature of the second (and optionally third) water-soluble material(s) are suitably adapted, this/these material (s) dissolve(s) at the correspondingly higher temperatures of the main wash or cleaning cycle and successively release(s) the particular washing preparation(s) into the wash liquor. In this embodiment of the invention, in which the water-soluble materials becoming successively soluble in water with increasing temperature surround different washing preparations to form part-portions, qualitatively different washing preparations and/or quantitatively different washing preparations are successively released into the wash liquor as its temperature increases at different times of the same wash cycle, in the present case the main wash or cleaning cycle, thus enabling the washing components present in the wash liquor to be better adapted to the requirements of the particular wash cycle.

In the example discussed in the foregoing, the washing preparation(s) intended for the final wash cycle or the clear-rinse cycle is/are surrounded by one or more material (s) dissolving in water at relatively high temperatures and can thus be released into the wash liquor at temperatures which correspond to the following final wash or clear-rinse cycle and which, for example in dishwashing, are even higher than the highest temperature of the main wash cycle.

In another embodiment of the invention which is preferred for its ready adaptability to the practical conditions prevailing during washing or dishwashing, a first measured quantity of a washing preparation is provided as a part-portion in a laundry/dishwasher detergent portion and passes into the aqueous phase at a temperature below or equal to a first temperature; a second measured quantity of a second washing preparation is provided as a part-portion which passes into the aqueous phase at a temperature below or equal to a second temperature which is above the first temperature and both washing preparations are surrounded by a water-soluble material. In this case, the solubility of the water-soluble material in water is adjusted so that it dissolves under the conditions, for example at the temperature, under/at which the washing preparation required as the first washing preparation is to be released into the wash liquor. This case is of course similarly applicable to three or even more than three part-portions of washing preparations.

According to the invention, the following "sub-cases" of such laundry/dishwasher detergent portions are particularly preferred:

The first measured quantity of a washing preparation is a preparation adapted and intended for the main wash cycle which is present in the form of a powder or in the form of particles or in the form of a shaped body and which, together with a second measured quantity of a washing preparation, is surrounded by a water-soluble material of which the solubility in water is adjusted to the lowest temperature of the main wash cycle. The second washing preparation may be a washing preparation for the main wash cycle in a second stage or a washing preparation for the final wash or clear-rinse cycle. In one particularly preferred embodiment, the second washing preparation is present in a form in which it is protected against immediate contact with water and subsequent dissolution in the wash liquor at the time at which the material surrounding the first measured quantity of a washing preparation is already dissolving in water. The form in which the second measured quantity of a washing preparation is present may be, for example, a form in which it is surrounded by its own water-soluble material which only dissolves in water at another temperature, for example a higher temperature. In another embodiment of the invention, the second washing preparation may be a washing preparation incorporated in a matrix in which the matrix material protects the washing preparation against contact with water and only allows contact with water (for example through dissolution, melting or the like) when other conditions prevail, for example when a higher temperature is reached. In another embodiment of the invention, a washing preparation which dissolves immediately for the low-temperature wash cycle, for example a powder-form washing preparation, together with a particulate material or a shaped body of a second washing preparation (and of course even a third washing preparation) may be surrounded by a material dissolving in water at low temperatures, the first, second and optionally third washing preparations being dissolution-retarded which the expert in this field can achieve by known measures, such as, for example, tabletting, coating with a material dissolving in water at relatively high temperatures or similar measures. In another embodiment of the invention, two measured quantities of washing preparations may be surrounded by the same water-soluble material which dissolves in water, for example, at the lowest temperature at which the laundry/dishwasher detergent portion is to be used, although the two preparations were designed for different solubility in aqueous medium, for example by tabletting to different densities and/or by coating with materials dissolving in water at different rates (and/or by coating only in the case of one washing preparation) and/or by introduction into matrix materials with different properties (and/or by introduction into a matrix only in the case of one washing preparation), etc. All the cases mentioned above may of course also be applied to combinations of three or more washing preparations, particularly in cases where several washing preparations are intended to be released at different times in a washing/dishwashing cycle.

Another preferred laundry/dishwasher detergent portion according to the invention is characterized in that certain ingredients pass into the wash liquor separated from others and thus contribute towards an improved effect. In the exemplary and non-limiting case of a dishwasher detergent, washing preparations sensitive to other components of washing preparations can only develop their full effectiveness when this sensitivity is taken into account.

Enzymes are typical examples of such components. Even if their use is optimized in regard to temperature, their performance is distinctly inferior in the presence of bleaching agents. According to the invention, therefore, enzymes can be released into the wash liquor before the bleaching agents by preventing the bleaching agents from entering the wash liquor too early by surrounding them with a water-soluble material. Only after the enzymes have had sufficient time to act, possibly at low temperatures, i.e. in the pre-cleaning cycle, are bleaching agents released into the wash liquor through dissolution of the material surrounding them in water. It is equally possible to use enzymes in the main wash cycle only and to introduce other washing preparations intended for the main wash cycle into the wash liquor after the enzymes, for example by tabletting, coating with a water-soluble material, etc. In this way, the action time of the enzymes can be extended (preferably even into the pre-cleaning time) so that the cleaning result is distinctly improved.

In a comparable and similarly preferred case, a rinse aid or fabric softener and/or perfume separated from the components of the main wash cycle and/or pre-cleaning cycle by a separate coating which only dissolves in water at the temperatures of the clear-rinse cycle is provided for the final wash or clear-rinse cycle.

Both cationic surfactants and anionic surfactants may be used in a laundry/dishwasher detergent portion. Due to the formation of ion pairs between the anionic and the cationic surfactant, unwanted flocculation can occur. According to the invention, this is prevented by protecting the cationic surfactant and the anionic surfactant by separate water-soluble coatings which dissolve at different temperatures. Thus, the cationic surfactant can be protected, for example, by a water-soluble coating which dissolves at the temperatures of the prewash cycle while the anionic surfactant is protected by a water-soluble coating which dissolves at the temperatures of the main wash cycle.

Acidic and alkaline active substances may also be used in a laundry/dishwasher detergent portion. Because the main wash cycle normally takes place in alkaline medium, it may be appropriate, for example, to use acid against tea stains in the pre-cleaning cycle. In order to prevent mutual neutralization, the components of the pre-cleaning cycle containing the acidic active substance and the components of the main wash cycle may be protected by separate water-soluble coatings which actually dissolve at the temperatures of the pre-cleaning cycle or only at the temperatures of the main wash cycle.

Similarly, it makes sense if active substances with an antimicrobial effect are used before and/or after the detergent components of the main wash cycle. The use of antimicrobially active substances in the pre-cleaning cycle has the advantage that the propagation and proliferation of microbes in the main wash cycle is prevented or at least reduced. However, the active substance is subsequently washed away with the wash liquor. By contrast, an antimicrobially active substance used in the final wash cycle can be deposited on the washing and the machine and can thus develop a long-lasting antimicrobial effect. The corresponding action mechanism can be obtained if the antimicrobially active substance is protected by a water-soluble coating which dissolves in water either at the temperatures of the prerinse cycle or only at the temperatures of the final-rinse cycle.

In addition, the early release of co-builders and complexing agents and the delayed release of hygiene aids, cellulase, complexing agents and soil-release polymers are advisable. This can also be achieved under the principle mentioned above whereby these active substances are separated from one another, i.e. surrounded, by water-soluble coatings which dissolve at the various temperatures of the corresponding cleaning cycles.

By contrast, it may be desirable to add such components as, for example, perfume, bleach and bleach activators in constant doses over the entire washing/cleaning cycle. This may be achieved, for example, by surrounding all these components with separate water-soluble materials dissolving at different temperatures.

In cases such as those mentioned above, it is possible to use laundry/dishwasher detergent portions which contain two laundry/dishwasher detergent part-portions (for example with a coating dissolving in cold water for the pre-wash or pre-cleaning cycle and with a coating dissolving in warm water for the main wash or main cleaning cycle or with a coating dissolving in warm water for the main wash or cleaning cycle and a coating dissolving in hot water for the final wash or clear-rinse cycle) or even laundry/dishwasher detergent portions which contain three or even more detergent part-portions, i.e. one each for the prewash, main wash and final wash cycles of the washing/dishwashing program, or even those in which several part-portions are provided for individual cycles of the program as a whole.

In every case, washing preparations are advantageously available at exactly the time and in the quality and quantity in the washing/dishwashing cycle at which they develop optimal activity without being disturbed by washing components which impair optimal activity.

In another preferred embodiment of the detergent portion according to the invention, at least the second measured quantity of a washing preparation is surrounded by a water-soluble material which is soluble at a temperature above the first temperature, i.e. at a temperature which is above the temperature at which the first washing or cleaning cycle takes place. The second washing preparation is thus advantageously protected against contact with the wash liquor until the first washing or cleaning cycle is complete.

Besides the temperature-controlled release described above, other release systems which make use of other control parameters than the temperature may be used for the controlled release of active substances.

In one of these other release systems, the control parameter of cooling is used for controlled release, for example in contrast to a certain maximum reachable temperature. Thus, an earlier hitherto unpublished German patent application in applicant's name describes laundry/dishwasher detergents containing polymers which are referred to as LCST polymers and which have the particular property that they are insoluble above a certain temperature (flocculation point) and only dissolve at lower temperatures. This principle can be used for any applications where certain components are intended to be released below the flocculation point of the LCST polymers during the cooling phase of the washing/dishwashing process. Applications which meet these criteria are, for example, machine dishwashing and machine washing as long as the wash liquor is pumped off in intermediate rinsing and washing cycles and replaced by colder or cold washing/rinsing water.

Another release system for the controlled release of active substances is based on the fact that, when a volume of air heated to a certain temperature is cooled, it undergoes a reduction in volume of about 1/272 per °Kelvin. Through a suitable supply form, for example a capsule with perforations, material can be taken into the supply form from the surrounding environment through the reduced pressure established by the contraction in air volume, initiating secondary processes, such as corrosion, dissolution, heating or gas formation which enable the required ingredients to be released.

Another release system for the controlled release of active substances uses (physico)chemical triggers which undergo a change in their physicochemical properties in the event of a change in the pH of the wash liquor. Substances which show increased solubility in water as a result of a change in pH occurring in the wash liquor are particularly preferred as (physico)chemical triggers. Alternatively or in addition, substances which undergo a change, particularly a reduction in their diffusion density, in the event of the corresponding change in the pH of the wash liquor are preferred as triggers. Besides the thermodynamic solubility, the dissolving kinetics of a film-form substance or a reduction in its mechanical stability can also be of significance in this regard.

These pH-shift-sensitive triggers can be used for any applications, particularly in the field of laundry/dishwasher detergents, where an active substance is to be released in the event of a reduction in pH from the alkaline to the neutral range. This can be the case both in the field of machine washing and in the field of machine dishwashing. In particular, parts of a detergent formulation for dishwashing machines (for example surfactants, perfume, soil repellent, acid, complexing agent, builders etc. and preparations containing these active subtonics) may be formulated so that they are not released in the main wash cycle at high pH values, but are released in the following clear-rinse cycle with its relatively low pH value.

Another release system is the enzyme-controlled release of active substances. In this case, enzyme-degradable (enzyme-sensitive) materials are used either as carriers or as coating materials, more particularly for shaped bodies, for example tablets, or capsules of active substances of laundry/dishwasher detergents. The enzymes typically present in laundry/dishwasher detergents degrade the enzyme-sensitive carrier material after a certain contact time and, hence, release the active substances of the laundry/dishwasher detergents present in the carrier material or rather in the coated tablets, granules or capsules.

Another release system for the controlled release of active substances is a (physico)chemical trigger in which a redox system is used. As in the case of enzyme-controlled release, the redox materials used in redox-controlled release may be used either as carriers or as coating materials, particularly for shaped bodies, for example tablets, or capsules of active substances of laundry/dishwasher detergents. After a certain contact time of redox-active components typically present in laundry/dishwasher detergents, the redox-sensitive carrier or coating material undergoes a chemical change, resulting in the release of the active substances of the laundry/dishwasher detergents present in the coated tablets, granules or capsules.

Another release system for the controlled release of active substances is a (physico)chemical trigger which produces an electrolyte-controlled release of active substances. In the case of dishwasher detergents, the difference in the electrolyte content between the cleaning cycle and the clear-rinse cycle in machine dishwashing may be utilized in this regard.

In another preferred embodiment of the invention, the water-soluble material surrounding at least the second measured quantity of a washing preparation is a water-soluble pack. In the context of the invention, a pack is understood to be a flat part which completely surrounds the second measured quantity of a washing preparation. The exact form of such a pack is not critical and may largely be adapted to the conditions of use. For example, plastic films processed to various forms (such as tubes, pouches, cylinders, bottles, disks or the like), capsules and other possible forms are suitable. According to the invention, films which may be bonded and/or sealed, for example, to form such packs as tubes, pouches or the like after they have been filled with part-portions of the laundry/dishwasher detergent portions according to the invention are particularly preferred.

According to the invention, plastic film packs of water-soluble films are also preferred by virtue of the excellent adaptability of their properties to the required physical conditions. Such films are known in principle from the prior art and, in one particularly preferred embodiment, belong to the group consisting of (acetalized) polyvinyl alcohol, polyvinyl pyrrolidone, polyethylene oxide, gelatine, cellulose and their derivatives and mixtures of the materials mentioned.

Polyvinyl alcohols, referred to in short as PVALs, are polymers with the following general structure:

$$[—CH_2—CH(OH)—]_n$$

which also contain small amounts of structural units of the following type:

$$[—CH_2—CH(OH)—CH(OH)—CH_2]$$

Since the corresponding monomer (vinyl alcohol) is not stable in free form, polyvinyl alcohols are produced via polymer-analog reactions by hydrolysis and—on an industrial scale—above all by alkali-catalyzed transesterification of polyvinyl acetates with alcohols, preferably methanol. PVALs with a predetermined residual percentage of acetate groups can also be obtained by these industrial processes.

Commercially available PVALs (for example Mowiol® types, products of Hoechst) are marketed as white-yellowish powders or granules with degrees of polymerization of ca. 500 to 2,500 (corresponding to molecular weights of ca. 20,000 to 100,000 g/mole) and have different degrees of hydrolysis of 98–99 or 87–89 mole-%. Accordingly, they are partly saponified polyvinyl acetates with a residual content of acetyl groups of ca. 1–2 or 11–13 mole-%.

The solubility of PVALs in water can be reduced and thus selectively adjusted to required values by aftertreatment with aldehyde (acetalization), by complexing with Ni or Cu salts or by treatment with dichromates, boric acid, borax. Films of PVAL are largely impervious to gases, such as oxygen, nitrogen, helium, hydrogen, carbon dioxide, but are permeable to water vapor.

Examples of suitable water-soluble PVAL films are the PVAL films obtainable under the name of "SOLUBLON®" from Syntana Handelsgesellschaft E. Harke GmbH & Co. Their solubility in water can be very precisely adjusted and films of this product series soluble in water in all the temperature ranges relevant to practical application are obtainable.

Polyvinyl pyrrolidones, referred to in short as PVPs, correspond to the following general formula:

PVPs are produced by radical polymerization of 1-vinyl pyrrolidone. Commercially available PVPs have molecular weights of ca. 2,500 to 750,000 g/mole and are commercially available as white hygroscopic powders or as aqueous solutions.

Polyethylene oxides, referred to in short as PEOXs, are polyalkylene glycols corresponding to the following general formula:

$$H—[O—CH_2—CH_2]_n—OH$$

which are produced on an industrial scale by base-catalyzed polyaddition of ethylene oxide (oxirane) with ethylene glycol as starter molecule in systems generally containing small quantities of water. They have molecular weights in the range from ca. 200 to 5,000,000 g/mole, corresponding to degrees of polymerization n of ca. 5 to >100,000. Polyethylene oxides have an extremely low concentration of reactive terminal hydroxy groups and possess only weak glycol properties.

Gelatine is a polypeptide (molecular weight ca. 15,000–>250,000 g/mole) which is mainly obtained by hydrolysis of the collagen present in the skin and bones of animals under acidic or alkaline conditions. The amino acid composition of gelatine largely corresponds to that of the collagen from which it was obtained and varies according to its provenance. The use of gelatine as a water-soluble capsule material is particularly widespread in pharmacy (hard or soft gelatine capsules). Gelatine is rarely used in the form of films on account of its high price compared with the polymers mentioned above.

Other preferred detergent portions according to the present invention are those of which the pack consists of water-soluble film of at least one polymer from the group of starch and starch derivatives, cellulose and cellulose derivatives, more especially methyl cellulose and mixtures thereof.

Starch is a homoglycan in which the glucose units are attached by a glycoside bonds. Starch is made up of two components of different molecular weight, namely ca. 20–30% straight-chain amylose (molecular weight ca. 50,000 to 150,000) and 70–80% of branched-chain amylopectin (molecular weight ca. 300,000 to 2,000,000). Small quantities of lipids, phosphoric acid and cations are also present. Whereas the amylose—on account of the bond in the 1,4-position—forms long, helical entwisted chains containing about 300 to 1,200 glucose molecules, the amylopectin chain branches through a 1,6-bond after—on average—25 glucose units to form a branch-like structure containing about 1,500 to 12,000 glucose molecules. Besides pure starch, starch derivatives obtainable from starch by polymer-analog reactions may also be used in accordance with the invention for the production of water-soluble wrappers for the detergent portions. Such chemically modified starches include, for example, products of esterification or etherification reactions in which hydroxy hydrogen atoms were substituted. However, starches in which the hydroxy groups have been replaced by functional groups that are not attached by an oxygen atom may also be used as starch derivatives. The group of starch derivatives includes, for example, alkali metal starches, carboxymethyl starch (CMS), starch esters and ethers and amino starches.

Pure cellulose has the formal empirical composition $(C_6H_{10}O_5)_n$ and, in formal terms, is a B-1,4-polyacetal of cellobiose which, in turn, is made up of two molecules of glucose. Suitable celluloses consist of ca. 500 to 5,000 glucose units and, accordingly, have average molecular weights of 50,000 to 500,000. Other cellulose-based disintegrating agents which may be used in accordance with the present invention are cellulose derivatives obtainable from cellulose by polymer-analog reactions. Such chemically modified celluloses include, for example, products of esterification or etherification reactions in which hydroxy hydrogen atoms were substituted. However, celluloses in which the hydroxy groups have been replaced by functional groups that are not attached by an oxygen atom may also be used as cellulose derivatives. The group of cellulose derivatives includes, for example, alkali metal celluloses, carboxymethyl cellulose (CMC), cellulose esters and ethers and also aminocelluloses.

Preferred wrappers of water-soluble film consist of a polymer with a molecular weight in the range from 5,000 to 500,000 dalton, preferably in the range from 7,500 to 250,000 dalton and more preferably in the range from 10,000 to 100,000 dalton. The water-soluble film which forms the wrapper has a thickness of 1 to 150 $\mu$m, preferably 2 to 100 $\mu$m, more preferably 5 to 75 $\mu$m and most preferably 10 to 50 $\mu$m.

The water-soluble films may be produced by various processes. In principle, they may be produced by blowing, extrusion and casting processes. In one preferred process, which starts out from a melt and uses a blowing mandrel, the films are blown with air to form a tube. In the extrusion process, which is another preferred production process, the raw materials plasticized by suitable additives are sprayed to form the films. It may be necessary in the extrusion process to dry the films after spraying. In the casting process, which is another preferred production process, an aqueous polymer preparation is applied to a heatable drying roller, optionally cooled after evaporation of the water and the film formed is removed from the roller. This film may optionally be powdered before or during its removal from the roller.

According to the invention, particularly preferred wrappers for the second measured quantity of a washing preparation are polyvinyl alcohol films which are soluble at a temperature in a range which corresponds to the temperature range of the washing/dishwashing cycle in which the second measured quantity of a washing preparation is used. The temperature in question, for example in the case where the second measured quantity of a washing preparation is a preparation for the main wash cycle of a dishwashing machine, is the temperature of the main wash cycle, for example a temperature in the range from > about 20 to about 55° C., preferably >25° C. to below 45° C. and more preferably a temperature above 30° C. to, for example, 40° C. In the case where the second measured quantity of a washing preparation is a preparation for the clear-rinse cycle of a dishwashing machine, the temperature at which the film dissolves in water is the temperature of the clear-rinse cycle, for example a temperature of >45° C., for example in the range from 50 to 55° C. or even higher. In line with the requirements and typical settings of the machines, other temperature ranges are relevant to washing processes carried out in washing machines, for example up to about 25° C. for the prewash cycle, up to about 90° C. for the main wash cycle and up to about 30° C. for the final wash cycle. The temperatures at which the water-soluble film dissolves can of course be adjusted within wide limits. In addition, films adjusted to a certain water-solubility temperature range (cf. the above-mentioned films of the MOWIOL® type or the SOLUBLON® type) are commercially obtainable. The expert is thus able to select such films according to requirements.

In another preferred embodiment of the present invention, the water-soluble material surrounding the second measured quantity of a washing preparation is a water-soluble capsule. Such capsules are also known from the prior art. They may be, for example, capsules of PVAL, gelatine or similar materials, but are by no means confined to materials such as these. Such capsules are commercially obtainable and are widely used in connection with pharmaceutical preparations and food additives. Capsules of hard gelatine or soft gelatine have proved to be particularly successful and, accordingly, are particularly preferred for the purposes of the invention.

In another preferred embodiment of the invention, the water-soluble material surrounding at least the second measured quantity of a washing preparation is a water-soluble coating. Such coatings or membrane materials are used for coating washing substances in the prior art and, like the film materials, may be adjusted in their physical and chemical properties, for example their solubility in water, melting point or melting range, to meet certain technical requirements. For the purposes of the present invention, coatings soluble in water in the narrower sense are as suitable for coating washing preparations as coatings which dissolve in an aqueous environment providing certain physical or chemical conditions, for example a certain temperature or a certain pH, are established because, for example, they melt and the membrane materials are then dispersed in water so that the ingredients previously surrounded by the coating or membrane are released.

In this sense, the term "water-soluble" in the context of the present invention generally encompasses not only the ability of the coatings/membranes of the washing preparations to be dissolved by an aqueous medium (in the narrower sense), but also their ability (in the broader sense) to change when certain or physical or chemical conditions are established in the aqueous environment so that their physical integrity is lost and the coating/membrane releases the ingredients into the aqueous phase. The melting and subsequent dispersion of the membrane/coating material in the aqueous phase is a typical (but non-limiting) example of this.

Basically, the coatings or capsule materials should have a melting range at temperatures at which the active substances to be coated/encapsulated are not exposed to significant thermal stressing. On the other hand, however, the melting range must be high enough still to afford the encapsulated washing preparations effective protection at least slightly elevated temperatures. According to the invention, the coating/encapsulating materials have melting ranges between about 45° C. and about 75° C. The expression "melting range" in the present case means that the melting range lies within the temperature range mentioned and does not denote the width of the melting range. Coatings of waxes have proved to be particularly effective in this connection because they can be directly applied to the washing preparation or its individual components. Accordingly, such coating are particularly preferred because they are easy to apply and because their solubility in water can be exactly adjusted and hence optimally adapted to meet particular requirements. "Waxes" in the context of the present invention are understood to be any of a number of natural or synthetic substances which generally melt above 40° C. without decomposing and, even just above their melting point, are of relatively low viscosity and non-stringing. Their consistency and solubility are dependent to a large extent on temperature.

Waxes are divided into three groups according to their origin, namely: natural waxes, chemically modified waxes and synthetic waxes.

The natural waxes include, for example, vegetable waxes, such as candelilla wax, camauba wax, Japan wax, esparto grass wax, cork wax, guaruma wax, rice oil wax, sugar cane wax, ouricury wax or montan wax, animal waxes, such as bees wax, shellac wax, spermaceti, lanolin (wool wax) or uropygial fat, mineral waxes, such as ceresine or ozocerite (earth wax), or petrochemical waxes, such as petrolatum, paraffin waxes or microwaxes.

The chemically modified waxes include, for example, hard waxes, such as montan ester waxes, sassol waxes or hydrogenated jojoba waxes.

Synthetic waxes are generally understood to be polyalkylene waxes or polyalkylene glycol waxes. Compounds from other classes which satisfy the above-mentioned softening point requirements may also be used as coating/encapsulating materials. For example, higher esters of phthalic acid, more particularly the dicyclohexyl phthalate commercially available under the name of Unimoll® 66 (Bayer AG), have proved to be suitable synthetic compounds. Synthetic waxes of lower carboxylic acids and fatty alcohols, for example the dimyristyl tartrate commercially available under the name of Cosmacol®ETLP (Condea), are also suitable. Conversely, synthetic or partly synthetic esters of lower alcohols with fatty acids from native sources may also be used. This class of substances includes, for example, Tegin® 90 (Goldschmidt), a glycerol monostearate palmitate. Schellack-KPS-Dreiring-SP (Kalkhoff GmbH) may also be used as a coating/encapsulating material in accordance with the invention.

In the context of the invention, the waxes also include, for example, the so-called wax alcohols. Wax alcohols are relatively high molecular weight water-insoluble fatty alcohols generally containing about 22 to 40 carbon atoms. The wax alcohols are used as a principal constituent of many natural waxes, for example in the form of wax esters of relatively high molecular weight fatty acids (wax acids). Examples of wax alcohols are lignoceryl alcohol (1-tetracosanol), cetyl alcohol, myristyl alcohol or melissyl alcohol. The coating of the washing preparations may also contain wool wax alcohols which are understood to be triterpenoid and steroid alcohols, for example the lanolin obtainable, for example, under the name of Argowax® (Pamentier & Co.). According to the invention, fatty acid glycerol esters or fatty acid alkanolamides and also water-insoluble or substantially water-insoluble polyalkylene glycol compounds may also be used at least partly as an encapsulating material.

In one preferred embodiment, the coatings used in accordance with the invention predominantly contain paraffin wax. In another preferred embodiment, at least 50% by weight of the total of encapsulating materials present and preferably more consists of paraffin wax. Paraffin wax contents (based on total enapsulating material) of about 60% by weight, about 70% by weight or about 80% by weight are particularly suitable, even higher contents of, for example, more than 90% by weight being particularly preferred. In one particular embodiment of the invention, the total quantity of encapsulating material used consists of paraffin wax. So far as the present invention is concerned, paraffin waxes have the advantage over the other natural waxes mentioned that the waxes do not undergo hydrolysis in an alkaline detergent environment (as might be expected, for example, in the case of the wax esters), because a paraffin wax does not contain any hydrolyzable groups.

Paraffin waxes consist principally of alkanes and small amounts of iso- and cycloalkanes. The paraffin waxes preferably used in accordance with the invention preferably contain virtually no constituents with a melting point above 70° C. and, more preferably, above 60° C. If the temperature in the washing/cleaning solution falls below this melting temperature, high-melting alkanes in the paraffin can leave unwanted wax residues behind on the laundry to be washed or the ware to be cleaned. Wax residues such as these generally leave the cleaned surface with an unattractive appearance and should therefore be avoided. The encapsulating substances used in accordance with the invention contain a paraffin wax with a melting range of 50° C. to 60° C.

The paraffin wax used preferably has a high content of alkanes, isoalkanes and cycloalkanes solid at ambient temperature (generally about 10 to about 30° C.). The higher the percentage of solid wax constituents present in a wax at room temperature, the more useful that wax is for the purposes of the present invention. The higher the percentage of solid wax constituents, the greater the resistance of the coated particles to impact or friction with other surfaces, which leads to better protection of the washing substances present in the particles.

Besides paraffin as principal constituent, the coating material may also contain one or more of the waxes or wax-like substances mentioned above. Basically, the composition of the mixture forming the encapsulating/coating material should be such that the coated particles are at least substantially insoluble in water. Their solubility in water should not exceed about 10 mg/l at a temperature of about 30° C. and should preferably be below 5 mg/l. At all events, the coating should have very low solubility in water, even in water at elevated temperature, in order largely to avoid the active washing substances being released independently of temperature.

The principle described above facilitates the delayed release of washing preparations at a certain time in the washing or cleaning cycle and may be applied with particular advantage when the main wash cycle is carried out at a relatively low temperature (for example 45° C.), so that the active washing substance is only released from the coated particles comprising a rinse aid in the final rinse cycle at relatively high temperatures (for example >55° C.).

Membrane materials or coatings preferably used in accordance with the invention comprise one or more substances with a melting range of 40° C. to 75° C. in quantities of 6 to 30% by weight, preferably 7.5 to 25% by weight and more preferably 10 to 20% by weight, based on the weight of the particles.

Irrespective of the particular embodiment of the water-soluble material surrounding the second measured quantity of a washing preparation and thus preventing its premature release into the wash liquor, it is particularly preferred for this material to be a material which does not dissolve in cold water. The second washing preparation can thus be prevented from passing into the wash liquor before the temperature of the washing/cleaning cycle reaches the temperature required for the main wash cycle (in cases where the second washing preparation is intended for the main wash cycle) or the temperature required for the final wash cycle or the clear-rinse cycle (in cases where the second washing preparation is intended for the final wash cycle or the clear-rinse cycle).

In another preferred embodiment of the invention, the first and optionally the third and further (fourth, fifth etc.) washing preparations present in the detergent portions according to the invention are surrounded individually (i.e. the first or the third or . . . ) or respectively (i.e. the first and the third and . . . ) or even partly (i.e. the first and the third or the first and the fourth or . . . ) by a water-soluble material or by water-soluble materials. These materials may belong to the same physical group (film, capsule, coating etc.) or chemical group (PVAL films, PVP films, PEOX films etc.) or to different groups. The foregoing observations apply to the composition of these materials. In other words, analogously to the above disclosure in respect of the material surrounding the second measured quantity of a washing preparation, the expert may also select a material to surround the first measured quantity of a washing preparation and/or a material to surround the third measured quantity, if any, of a washing preparation and/or a material to surround further measured quantities, if any, of washing preparations, having above all to bear in mind which components the particular washing preparations contain as part-portions of the laundry/dishwasher detergent portion according to the invention, when (and at what temperatures) they are to be released into the wash liquor and, optionally, how quickly this is to take place. The criteria mentioned above apply accordingly to the other water-soluble materials.

Thus, another preferred embodiment of the invention is a detergent portion in which, in addition, the first measured quantity of a washing preparation is surrounded by a first water-soluble material and this first water-soluble material is a material which dissolves in water at a temperature below or equal to the first temperature. Where the first washing preparation is a preparation for the pre-wash or pre-rinse cycle, the temperature in question is the maximum temperature of a pre-wash or pre-rinse cycle and is normally the temperature of the cold water. If the first washing preparation is a preparation for the main wash cycle, the temperature in question is the maximum temperature of a main wash cycle and, in the case of dishwashing, is normally a temperature below 45° C. and, in one particularly preferred embodiment, a temperature of 30 to 45° C.

Another preferred embodiment of the invention is characterized in that, in addition, the third measured quantity of a washing preparation is surrounded by a third water-soluble material and this third water-soluble material is a material which dissolves in water at a temperature above the second temperature. Examples are laundry/dishwasher detergent portions according to the invention consisting of a pre-wash, main wash and final wash component. In this case, the water-soluble material surrounding the third washing preparation for the final wash or clear-rinse cycle dissolves at high temperatures—in the case of dishwashing for example at >45° C. and, more preferably, at 50 to 55° C. or even as high as 65° C.

Other preferred embodiments of the laundry/dishwasher detergent portions according to the invention are characterized in that the first and the second and optionally the third measured quantities of washing preparations are present in the form of interconnected part-portion packs separately surrounded by the first, second and optionally third water-soluble material. The laundry/dishwasher detergent portions are not confined to a total of two or optionally three washing preparations and the water-soluble materials surrounding those preparations, but instead may equally well comprise four or five or more part-portion packs which are joined to form a laundry/dishwasher detergent portion. The individual washing preparations may be surrounded by the water-soluble material of which the solubility in water is exactly adjusted to the conditions (for example the temperature conditions) under which the water-soluble material surrounding the particular preparation develops optimal and rapid solubility to release the contents of the particular part-portion into the liquor. The two, three or more sub-units are joined to form a laundry/dishwasher detergent portion according to the invention.

In other embodiments of the laundry/dishwasher detergent portions according to the invention, several washing preparations or part-portions may be surrounded by a film bag or a capsule. In that case, the solubility of the film bag comprising several part-portions in water is adjusted to the temperature at which the component used earliest in the washing/cleaning cycle is to be released into the wash liquor. On reaching that temperature, the water-soluble material begins to dissolve, releasing several components of the laundry/dishwasher detergent portion into the wash liquor. However, these components do not necessarily dissolve (and hence act) in the wash liquor at the same time. Instead, the dissolving behavior of one of the components can be retarded by suitable measures so that the component in question is only released into the wash liquor at a later stage, for example at a relatively high temperature. This is preferably the case with a dishwasher detergent portion consisting of a washing preparation for the main wash cycle of a dishwashing machine and a washing preparation for the clear-rinse cycle. The dishwasher detergent portion can be dissolution-retarded, for example, by encapsulation in a matrix melting at the temperatures of the clear-rinse cycle (for example >55° C.). Another preferred case is one in which a dishwasher detergent portion containing several different washing preparations for the main wash cycle and optionally a washing preparation for the clear-rinse cycle is surrounded by a film which dissolves in water at the temperature prevailing at the beginning of the main wash cycle. When the film dissolves in warm water (for example at 22° C.), only a part-portion intended for the main wash cycle is dissolved in the wash liquor, the other components being protected against immediate dissolution in the wash liquor by suitable measures (encapsulation in a matrix, tabletting, coating, etc.). The other components only dissolve at a later stage when other process conditions, for example a higher temperature or another pH, come into play.

The sub-units of the laundry/dishwasher detergent portion according to the invention may consist, for example, of bags of two, optionally three or more, different film types or capsules with two or optionally even three or more compartments of materials differing in their composition. The various film types of the bags or the various materials of the capsule compartments are adjusted to a solubility in water under different conditions, for example different temperatures or different residence times in the wash liquor. They release their respective contents, i.e. the first, second and optionally third and further washing preparations, into the wash liquor when the conditions to whose water solubility the particular materials are adjusted come into play. These are preferably the temperatures of the particular wash cycles but may equally well be other conditions reproducibly adjustable in the washing/cleaning cycle.

In an alternative embodiment, which is also preferred for its compact appearance and which affords performance, logistical and operational advantages, the invention relates to laundry/dishwasher detergent portions in which the first and the second and optionally the third measured quantities of washing preparations are present in sandwich-like form or shell/core form with the layers of—going from outside inwards—first water-soluble material—first measured quantity of a washing preparation—second water-soluble material—second measured quantity of a washing preparation—(optionally) third water-soluble material—third measured quantity of a washing preparation. In this case, too, the shell/core structure is not confined to three layers of washing preparations, optionally with the water-soluble materials surrounding them, but may also comprise other "layers" of washing preparations optionally surrounded by water-soluble materials.

In a structure such as, the measured quantity of a washing preparation which is to develop its effect in the first washing/cleaning cycle and which is therefore at the lowest temperature is situated the furthest outwards and is preferably (but not necessarily) surrounded by a water-soluble material which dissolves in water under the conditions (for example at the temperature) prevailing in the first washing/cleaning cycle in which the laundry/dishwasher detergent portion thus made up is used. The next layer (going inwards) is the second washing preparation which at all events is surrounded by a (second) water-soluble material. Its solubility in water is adjusted so that the (second) water-soluble material dissolves optimally and quickly in the wash liquor at the temperature of the second washing/cleaning cycle. The foregoing description applies accordingly to any further (third, fourth etc.) washing preparations optionally present further to the inside.

In the laundry/dishwasher detergent portions according to the invention, the first, second and optionally third measured quantities of washing preparations independently of one another are preferably laundry/dishwasher detergent formulations in the form of shaped bodies, powders, gels or liquids. Laundry/dishwasher detergent preparations in the form of shaped bodies may be present as granules, tablets, blocks, briquettes, rings or other shaped bodies. More particularly, tablets, blocks or briquettes may be plain shaped bodies or shaped bodies with depressions, cavities, grooves or the like which are used to accommodate particular components of the preparations or which may even have a performance-related function. Liquid laundry/dishwasher detergent preparations may be solutions, suspensions or other liquid systems known for washing and cleaning purposes.

The laundry/dishwasher detergent portions contain one or more ingredients from the group of surfactants, surfactant compounds, builders, bleaching agents, bleach activators, enzymes, foam inhibitors, dyes and perfumes and—where the laundry/dishwasher detergent portions are at least partly present as tablets—binders and disintegration aids. These classes of ingredients are described in the following.

In order to develop their washing effect, the laundry/dishwasher detegent portions according to the invention contain surfactants from the group of anionic, nonionic, zwitterionic or cationic surfactants, anionic surfactants being greatly preferred both for economic reasons and by virtue of their performance spectrum.

Suitable anionic surfactants are, for example, those of the sulfonate and sulfate type. Suitable surfactants of the sulfonate type are preferably $C_{9-13}$ alkyl benzenesulfonates, olefin sulfonates, i.e. mixtures of alkene and hydroxyalkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products. Other suitable surfactants of the sulfonate type are the alkane sulfonates obtained from $C_{12-18}$ alkanes, for example by sulfochlorination or sulfoxidation and subsequent hydrolysis or neutralization. The esters of a-sulfofatty acids (ester sulfonates), for example the $\alpha$-sulfonated methyl esters of hydrogenated coconut oil, palm kernel oil or tallow fatty acids, are also suitable.

Other suitable anionic surfactants are sulfonated fatty acid glycerol esters. Fatty acid glycerol esters in the context of the present invention are the monoesters, diesters and triesters and mixtures thereof which are obtained where production is carried out by esterification of a monoglycerol with 1 to 3 moles of fatty acid or in the transesterification of triglycerides with 0.3 to 2 moles of glycerol. Preferred sulfonated fatty acid glycerol esters are the sulfonation products of saturated fatty acids containing 6 to 22 carbon atoms, for example caproic acid, caprylic acid, capric acid, myristic acid, lauric acid, palmitic acid, stearic acid or behenic acid.

Preferred alk(en)yl sulfates are the alkali metal salts and, in particular, the sodium salts of the sulfuric acid semiesters of $C_{12-18}$ fatty alcohols, for example cocofatty alcohol, tallow fatty alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{12-16}$ alkyl sulfates, $C_{12-15}$ alkyl sulfates and $C_{14-15}$ alkyl sulfates are preferred from the point of view of washing technology. Other suitable anionic surfactants are 2,3-alkyl sulfates which may be produced, for example, in accordance with U.S. Pat. No. 3,234,258 or U.S. Pat. No. 5,075,041 and which are commerially obtainable as products of the Shell Oil Company under the name of DAN®.

The sulfuric acid monoesters of linear or branched $C_{7-21}$ alcohols ethoxylated with 1 to 6 moles of ethylene oxide, such as 2-methyl-branched $C_{9-11}$ alcohols containing on average 3.5 moles of ethylene oxide (EO) or $C_{12-18}$ fatty alcohols containing 1 to 4 EO, are also suitable. In view of their high foaming capacity, they are only used in relatively small quantities, for example in quantities of 1 to 5% by weight, in detergents.

Other suitable anionic surfactants are the salts of alkyl sulfosuccinic acid which are also known as sulfosuccinates or as sulfosuccinic acid esters and which represent monoesters and/or diesters of sulfosuccinic acid with alcohols, preferably fatty alcohols and, more particularly, ethoxylated fatty alcohols. Preferred sulfosuccinates contain $C_{8-18}$ fatty alcohol residues or mixtures thereof. Particularly preferred sulfosuccinates contain a fatty alcohol residue derived from ethoxylated fatty alcohols which, considered in isolation, represent nonionic surfactants (for a description, see below). Of these sulfosuccinates, those of which the fatty alcohol residues are derived from narrow-range ethoxylated fatty alcohols are particularly preferred. Alk(en)yl succinic acid preferably containing 8 to 18 carbon atoms in the alk(en)yl chain or salts thereof may also be used.

Other suitable anionic surfactants are, in particular, soaps. Suitable soaps are saturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow fatty acids.

The anionic surfactants, including the soaps, may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts. In another embodiment of the invention, surfactants are used in the form of their magnesium salts.

According to the invention, preferred laundry/dishwasher detergent portions are those which contain 5 to 50% by weight, preferably 7.5 to 40% by weight and more preferably 15 to 25% by weight of anionic surfactant(s), based on the detergent portion.

So far as the choice of anionic surfactants used in the detergent portions according to the invention is concerned, there are no basic requirements to restrict the freedom of formulation. However, preferred the laundry/dishwasher detergent portions according to the invention do have a soap content in excess of 0.2% by weight, based on the total weight of the detergent portion. Preferred anionic surfactants are alkyl benzene-sulfonates and fatty alcohol sulfates, preferred detergent portions containing 2 to 20% by weight, preferably 2.5 to 15% by weight and more preferably 5 to 10% by weight of fatty alcohol sulfate(s), based on the weight of the laundry/dishwasher detergent portion.

Preferred nonionic surfactants are alkoxylated, advantageously ethoxylated, more especially primary alcohols preferably containing 8 to 18 carbon atoms and, on average, 1 to 12 moles of ethylene oxide (EO) per mole of alcohol, in which the alcohol radical may be linear or, preferably, methyl-branched in the 2-position or may contain linear and methyl-branched radicals in the form of the mixtures typically present in oxoalcohol radicals. However, alcohol ethoxylates containing linear radicals of alcohols of native origin with 12 to 18 carbon atoms, for example coconut oil, palm oil, tallow fatty or oleyl alcohol, and on average 2 to 8 EO per mole of alcohol are particularly preferred. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned represent statistical mean values which, for a special product, can be a whole number or a broken number. Preferred alcohol ethoxylates have a narrow homolog distribution (narrow range ethoxylates, NRE). In addition to these nonionic surfactants, fatty alcohols containing more than 12 EO may also be used, examples including tallow fatty alcohol containing 14 EO, 25 EO, 30 EO or 40 EO.

Another class of preferred nonionic surfactants which may be used either as sole nonionic surfactant or in combination with other nonionic surfactants are alkoxylated, preferably ethoxylated or ethoxylated and propoxylated, fatty acid alkyl esters preferably containing 1 to 4 carbon atoms in the alkyl chain, more especially the fatty acid methyl esters which are described, for example, in Japanese patent application JP 581217598 or which are preferably produced by the process described in International patent application WO-A-90113533.

Another class of nonionic surfactants which may advantageously be used are the alkyl polyglycosides (APGs). Suitable alkyl polyglycosides correspond to the general formula $RO(G)_z$ where R is a linear or branched, more particularly 2-methyl-branched, saturated or unsaturated aliphatic radical containing 8 to 22 and preferably 12 to 18 carbon atoms and G stands for a glycose unit containing 5 or 6 carbon atoms, preferably glucose. The degree of glycosidation z is between 1.0 and 4.0, preferably between 1.0 and 2.0 and more preferably between 1.1 and 1.4.

Linear alkyl polyglucosides, i.e. alkyl polyglycosides in which the polyglycosyl component is a glucose unit and the alkyl component is an n-alkyl group, are preferably used.

The laundry/dishwasher detergent portions according to the invention may advantageously contain alkyl polyglycosides, APG contents in the laundry/dishwasher detergent portions of more than 0.2% by weight, based on the press-agglomerated detergent as a whole, being preferred. Particularly preferred laundry/dishwasher detergent portions according to the invention contain APGs in quantities of 0.2 to 10% by weight, preferably in quantities of 0.2 to 5% by weight and more preferably in quantities of 0.5 to 3% by weight.

Nonionic surfactants of the amine oxide type, for example N-cocoalkyl-N,N-dimethylamine oxide and N-tallowalkyl-N,N-dihydroxyethylamine oxide, and the fatty acid alkanolamide type are also suitable. The quantity in which these nonionic surfactants are used is preferably no more than the quantity in which the ethoxylated fatty alcohols are used and, more preferably, no more than half that quantity.

Other suitable surfactants are polyhydroxyfatty acid amides corresponding to formula (I):

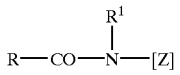

(I)

in which RCO is an aliphatic acyl group containing 6 to 22 carbon atoms, $R^1$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are known substances which may normally be obtained by reductive amination of a reducing sugar with ammonia, an alkylamine or an alkanolamine and subsequent acylation with a fatty acid, a fatty acid alkyl ester or a fatty acid chloride.

The group of polyhydroxyfatty acid amides also includes compounds corresponding to formula (II):

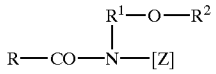

(II)

in which R is a linear or branched alkyl or alkenyl group containing 7 to 12 carbon atoms, $R^1$ is a linear, branched or cyclic alkyl group or an aryl group containing 2 to 8 carbon atoms and $R^2$ is a linear, branched or cyclic alkyl group or an aryl group or an oxyalkyl group containing 1 to 8 carbon atoms, $C_{1-4}$ alkyl or phenyl groups being preferred, and [Z] is a linear polyhydroxyalkyl group, of which the alkyl chain is substituted by at least two hydroxyl groups, or alkoxylated, preferably ethoxylated or propoxylated, derivatives of that group.

[Z] is preferably obtained by reductive amination of a reduced sugar, for example glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst, for example in accordance with the teaching of International patent application WO-A-95107331.

In another preferred embodiment, cationic surfactants may be used in addition to anionic and nonionic surfactants. They are mainly used as detergency boosters and need only be used in small quantities. If cationic surfactants are used, they are present in the detergents in quantities of preferably 0.01 to 10% by weight and more preferably in quantities of 0.1 to 3.0% by weight.

In cases where the laundry/dishwasher detergent portions according to the invention are laundry detergents, they normally contain one or more surfactant(s) in total quantities of 5 to 50% by weight and preferably 10 to 35% by weight, surfactants optionally being present in relatively large or relatively small quantities in part-portions of the laundry detergent portions according to the invention. In other words, the quantity of surfactant is not the same in all portions, instead part-portions with a relatively large surfactant content and part-portions with a relatively small surfactant content may be provided.

In cases where the laundry/dishwasher detergent portions according to the invention are cleaning compositions, more particularly dishwashing detergents, they normally contain one or more surfactants in total quantities of 0.1 to 10% by weight and preferably in quantities of 0.5 to 5% by weight, surfactants optionally being present in relatively large or relatively small quantities in part-portions of the laundry detergent portions according to the invention. In other words, with dishwashing detergents also, the quantity of surfactant is not the same in all portions, instead part-portions with a relatively large surfactant content and part-portions with a relatively small surfactant content may be provided.

Besides the active washing ingredients, builders are the most important ingredients of detergents. Any of the builders normally used in detergents may be present in the laundry/dishwasher detergent portions according to the invention, including in particular zeolites, silicates, carbonates, organic co-builders and also—providing there are no ecological objections to their use—phosphates.

Suitable crystalline layer-form sodium silicates correspond to the general formula $NaMSi_xO_{2x+1}\cdot yN_2O$, where M is sodium or hydrogen, x is a number of 1.9 to 4 and y is a number of 0 to 20, preferred values for x being 2, 3 or 4. Crystalline layer silicates such as these are described, for example, in European patent application EP-A0 164 514. Preferred crystalline layer silicates corresponding to the above formula are those in which M is sodium and x assumes the value 2 or 3. Both β- and δ-sodium disilicates $Na_2Si_2O_5\cdot yH_2O$ are particularly preferred, β-sodium disilicate being obtainable, for example, by the process described in International patent application WO-A-91/08171.

Other useful builders are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. However, particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these, which also dissolve with delay in relation to conventional waterglasses, are described for example in German patent application DE-A44 00 024. Compacted amorphous silicates, compounded amorphous silicates and overdried X-ray-amorphous silicates are particularly preferred.

A finely crystalline, synthetic zeolite containing bound water optionally is preferably zeolite A and/or zeolite P. Zeolite MAP® (for example Doucil A24, a Crosfield product) is a particularly preferred P-type zeolite. However, zeolite X and mixtures of A, X and/or P are also suitable. According to the invention, it is also possible to use, for example, a commercially obtainable co-crystallizate of zeolite X and zeolite A (ca. 80% by weight zeolite X) which is marketed by CONDEA Augusta S.p.A. under the name of VEGOBOND AX® and which may be described by the following formula:

$$nNa_2O\cdot(1-n)K_2O\cdot Al_2O_3\cdot(2-2.5)SiO_2\cdot(3.5-5.5)\ H_2O$$

Suitable zeolites have a mean particle size of less than 10 μm (volume distribution, as measured by the Coulter Counter Method) and contain preferably 18 to 22% by weight and more preferably 20 to 22% by weight of bound water.

The generally known phosphates may of course also be used as builders providing their use should not be avoided on ecological grounds. The sodium salts of the orthophosphates, the pyrophosphates and, in particular, the tripolyphosphates are particularly suitable.

Useful organic builders are, for example, polycarboxylic acids usable in the form of their sodium salts, polycarboxylic acids in this context being those carboxylic acids which carry more than one acid function. These include, for example, citric acid, adipic acid, succinic acid, glutaric acid, malic acid, tartaric acid, maleic acid, fumaric acid, sugar acids, amino-carboxylic acids, nitrilotriacetic acid (NTA)—providing its use is not ecologically unsafe—and mixtures thereof. Preferred salts are the salts of the polycarboxylic acids, such as citric acid, adipic acid, succinic acid, glutaric acid, tartaric acid, sugar acids and mixtures thereof. The acids per se may also be used. Besides their builder effect, the acids also typically have the property of an acidifying component and, hence, also serve to establish a relatively low and mild pH value in detergent portions according to the invention. Citric acid, succinic acid, glutaric acid, adipic acid, gluconic acid and mixtures thereof are particularly mentioned in this regard.

Other suitable builders are polymeric polycarboxylates such as, for example, the alkali metal salts of polyacrylic or polymethacrylic acid, for example those with a relative molecular weight of 500 to 70,000 g/mole.

The molecular weights mentioned in this specification for polymeric polycarboxylates are weight-average molecular weights $M_w$ of the particular acid form which, basically, were determined by gel permeation chromatography (GPC) using a UV detector. The measurement was carried out against an external polyacrylic acid standard which provides realistic molecular weight values by virtue of its structural similarity to the polymers investigated. These values differ distinctly from the molecular weights measured against polystyrene sulfonic acids as standard. The molecular weights measured against polystyrene sulfonic acids are generally higher than the molecular weights mentioned in this specification.

Particularly suitable polymers are polyacrylates which preferably have a molecular weight of 2,000 to 20,000 g/mole. By virtue of their superior solubility, preferred representatives of this group are the short-chain polyacrylates which have molecular weights of 2,000 to 10,000 g/mole and, more particularly, 3,000 to 5,000 g/mole.

Also suitable are copolymeric polycarboxylates, particularly those of acrylic acid with methacrylic acid and those of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weights, based on the free acids, are generally in the range from 2,000 to 70,000 glmole, preferably in the range from 20,000 to 50,000 g/mole and more preferably in the range from 30,000 to 40,000 g/mole.

The (co)polymeric polycarboxylates may be used either in the form of an aqueous solution or in powder form. The laundry/dishwasher detergent portions according to the invention preferably contain 0.5 to 20% by weight and more particularly 3 to 10% by weight of (co)polymeric polycarboxylates.

In order to improve solubility in water, the polymers may also contain allyl sulfonic acids, such as for example allyloxybenzene sulfonic acid and methallyl sulfonic acid (cf. EP-B-727 448), as monomer.

Other particularly preferred polymers are biodegradable polymers of more than two different monomer units, for example those which contain salts of acrylic acid and maleic acid and vinyl alcohol or vinyl alcohol derivatives as monomers according to DE-A-43 00 772 or those which contain salts of acrylic acid and 2-alkylallyl sulfonic acid and sugar derivatives as monomers according to DE-C-42 21 381.

Other preferred copolymers are those which are described in German patent applications DE-A-43 03 320 and DE-A44 17 734 and which preferably contain acrolein and acrylic acid/acrylic acid salts or acrolein and vinyl acetate as monomers.

Other preferred builders are polymeric aminodicarboxylic acids, salts or precursors thereof. Particular preference is attributed to polyaspartic acids or salts and derivatives thereof which, according to German patent application DE-A-195 40 086, are also said to have a bleach-stabilizing effect in addition to their co-builder properties.

Other suitable builders are polyacetals which may be obtained by reaction of dialdehydes with polyol carboxylic acids containing 5 to 7 carbon atoms and at least three hydroxyl groups, for example as described in European patent application EP-A-0 280 223. Preferred polyacetals are obtained from dialdehydes, such as glyoxal, glutaraldehyde, terephthalaldehyde and mixtures thereof and from polyol carboxylic acids, such as gluconic acid and/or glucoheptonic acid.

Other suitable organic builders are dextrins, for example oligomers or polymers of carbohydrates which may be obtained by partial hydrolysis of starches. The hydrolysis may be carried out by standard methods, for example acid- or enzyme-catalyzed methods. The end products are preferably hydrolysis products with average molecular weights of 400 to 500,000 g/mole. A polysaccharide with a dextrose equivalent (DE) of 0.5 to 40 and, more particularly, 2 to 30 is preferred, the DE being an accepted measure of the reducing effect of a polysaccharide by comparison with dextrose which has a DE of 100. Both maltodextrins with a DE of 3 to 20 and dry glucose sirups with a DE of 20 to 37 and also so-called yellow dextrins and white dextrins with relatively high molecular weights of 2,000 to 30,000 g/mole may be used. A preferred dextrin is described in British patent application 94 19 091.

The oxidized derivatives of such dextrins are their reaction products with oxidizing agents which are capable of oxidizing at least one alcohol function of the saccharide ring to the carboxylic acid function. Dextrins thus oxidized and processes for their production are known, for example, from European patent applications EP-A-0 232 202, EP-A-0 427 349, EP-A-0 472 042 and EP-A-0 542 496 and from International patent applications WO 92118542, WO 93/08251, WO 93/16110, WO 94128030, WO 95/07303, WO 95/12619 and WO 95/20608. An oxidized oligosaccharide corresponding to German patent application DE-A-196 00 018 is also suitable. A product oxidized at $C_6$ of the saccharide ring can be particularly advantageous.

Other suitable co-builders are oxydisuccinates and other derivatives of disuccinates, preferably ethylenediamine disuccinate. Ethylenediamine-N,N'-disuccinate (EDDS), of which the synthesis is described for example in U.S. Pat. No. 3,158,615, is preferably used in the form of its sodium or magnesium salts. The glycerol disuccinates and glycerol trisuccinates described, for example, in U.S. Pat. No. 4,524, 009, in U.S. Pat. No. 4,639, 325, in European patent application EP-A-0 150 930 and in Japanese patent application JP 93/339,896 are also particularly preferred in this connection. The quantities used in zeolite-containing and/or silicate-containing formulations are from 3 to 15% by weight.

Other useful organic co-builders are, for example, acetylated hydroxycarboxylic acids and salts thereof which may optionally be present in lactone form and which contain at least 4 carbon atoms, at least one hydroxy group and at most two acid groups. Co-builders such as these are described, for example, in International patent application WO-A-95/ 20029.

Another class of substances with co-builder properties are the phosphonates, more particularly hydroxyalkane and aminoalkane phosphonates. Among the hydroxyalkane phosphonates, 1-hydroxyethane-1,1-diphosphonate (HEDP) is particularly important as a co-builder. It is preferably used in the form of a sodium salt, the disodium salt showing a neutral reaction and the tetrasodium salt an alkaline reaction (pH 9). Preferred aminoalkane phosphonates are ethylenediamine tetramethylene phosphonate (EDTMP), diethylenetriamine pentamethylene phosphonate (DTPMP) and higher homologs thereof. They are preferably used in the form of the neutrally reacting sodium salts, for example as the hexasodium salt of EDTMP and as the hepta- and octasodium salt of DTPMP. Within the class of phosphonates, HEDP is preferably used as builder. The aminoalkane phosphonates also show a pronounced heavy metal binding capacity. Accordingly, it can be of advantage to use aminoalkane phosphonates, more especially DTPMP, or mixtures of the phosphonates mentioned, particularly if the laundry/dishwasher detergent portions according to the invention also contain bleach.

In addition, any compounds capable of complexing alkaline earth metal ions may be used as co-builders.

In addition to the ingredients—surfactants and builders—mentioned above, the laundry/dishwasher detergent portions according to the invention may contain other typical detergent ingredients, for example from the group of bleaching agents, bleach activators, enzymes, perfumes, perfume carriers, fluorescing agents, dyes, foam inhibitors, silicone oils, redeposition inhibitors, optical brighteners, discoloration inhibitors, dye transfer inhibitors and corrosion inhibitors.

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoperacid or diperdodecane dioic acid. If detergent or bleaching compositions for dishwashing machines are being produced, bleaching agents from the group of organic bleaches may also be used. Typical organic bleaching agents are diacyl peroxides, such as dibenzoyl peroxide for example. Other typical organic bleaching agents are the peroxy acids, of which alkyl peroxy acids and aryl peroxy acids are particularly mentioned as examples. Preferred representatives are (a) peroxybenzoic acid and ring-substituted derivatives thereof, such as alkyl peroxybenzoic acids, but also peroxy-α-naphthoic acid and magnesium monoperphthalate, (b) aliphatic or substituted aliphatic peroxy acids, such as peroxylauric acid, peroxystearic acid, ε-phthalimidoperoxycaproic acid [phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, diperoxyphthalic acids, 2-decyldiperoxybutane-1,4-dioic acid, N,N-terephthaloyl-di(6-aminopercaproic acid).

Other suitable bleaching agents in compositions for dishwashing machines are chlorine- and bromine-releasing substances. Suitable chlorine- or bromine-releasing materials are, for example, heterocyclic N-bromamides and N-chloramides, for example trichloroisocyanuric acid, tribromoisocyanuric acid, dibromoisocyanuric acid and/or dichloroisocyanuric acid (DICA) and/or salts thereof with cations, such as potassium and sodium. Hydantoin compounds, such as 1,3-dichloro-5,5-dimethyl hydantoin, are also suitable.

In order to obtain an improved bleaching effect where washing is carried out at temperatures of 60° C. or lower, bleach activators may be incorporated in the detergents according to the invention. The bleach activators may be compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl or isononanoyloxybenzenesulfonate (n- or iso-NOBS), carboxylic anhyd rides, more particularly phthalic anhyd ride, acylated polyhyd ric alcohols, more particularly triacetin, ethylene glycol diacetate and 2,5-diacetoxy-2,5-dihydrofuran.

In addition to or instead of the conventional bleach activators mentioned above, so-called bleach catalysts may also be incorporated in the laundry/dishwasher detergent portions. Bleach catalysts are bleach-boosting transition metal salts or transition metal complexes such as, for example, manganese-, iron-, cobalt-, ruthenium- or molybdenum-salen complexes or carbonyl complexes. Manganese, iron, cobalt, ruthenium, molybdenum, titanium, vanadium and copper complexes with nitrogen-containing tripod ligands and cobalt-, iron-, copper- and ruthenium-ammine complexes may also be used as bleach catalysts.

Suitable enzymes are those from the class of proteases, lipases, amylases, cellulases or mixtures thereof. Enzymes obtained from bacterial strains or fungi, such as Bacillus subtilis, Bacillus licheniformis and Streptomyces griseus, are particularly suitable. Proteases of the subtilisin type are preferred, proteases obtained from Bacillus lentus being particularly preferred. Enzyme mixtures, for example of protease and amylase or protease and lipase or protease and cellulase or of cellulase and lipase or of protease, amylase and lipase or of protease, lipase and cellulase, but especially cellulase-containing mixtures, are of particular interest. Peroxidases or oxidases have also proved to be suitable in some cases. The enzymes may be adsorbed to supports and/or encapsulated in membrane materials to protect them against premature decomposition. The percentage content of the enzymes, enzyme mixtures or enzyme granules in the compositions according to the invention may be, for example, from about 0.1 to 5% by weight and is preferably from 0.1 to about 2% by weight.

According to the prior art, enzymes are added primarily to a detergent preparation, more particularly a dishwasher detergent intended for the main wash cycle. The disadvantage was that the action optimum of the enzymes used restricted the choice of temperature and problems with the stability of the enzymes in strongly alkaline medium also occurred. With the laundry/dishwasher detergent portions according to the invention, enzymes may also be used in the pre-rinse cycle so that the pre-rinse cycle may be used in addition to the main wash cycle for enzymes to act on tableware soil.

In a particularly preferred embodiment of the invention, therefore, enzymes are added to the washing preparation intended for the pre-rinse cycle or to a part-portion of a dishwasher detergent portion and the preparation in question may preferably be wrapped in a material which dissolves in water at low temperatures in order, for example, to protect the enzyme-containing preparation against a loss of action by environmental conditions. The enzymes are preferably optimized for use under the conditions of the pre-rinse cycle, i.e. for example in cold water.

The laundry/dishwasher detergent portions according to the invention can be of advantage when the enzyme preparations are present in the liquid form sometimes available on the market because, in that case, a quick effect—already occurring in the pre-rinse cycle (relatively brief and carried out in cold water)—can be expected. Even if the enzymes are used in solid form, as they normally are, and are provided with a wrapping of a water-soluble material dissolving in cold water, the enzymes are able to develop their effect before the main wash cycle. The advantage of using a wrapper of a water-soluble material, more particularly a cold-water-soluble material, is that the enzyme(s) quickly become active in cold water after the wrapper dissolves. Their action time can thus be extended to the benefit of the washing/cleaning result.

In one particularly preferred embodiment, the laundry/dishwasher detergent portions according to the invention contain other additives known from the prior art as additives for washing or dishwashing preparations. These other additives may either be added to one or more, if necessary even all, of the part-portions (washing preparations) of the laundry/dishwasher detergent portions according to the invention or may be incorporated in the water-soluble materials in which the washing preparations are wrapped, i.e. for example in the water-soluble films, but also in capsules or coatings which may act as wrappers, as described for example in co-pending patent application DE 199 29 098.9 filed under the title "Active-substance portion pack".

A preferred group of additives used in accordance with the invention are optical brighteners. The optical brighteners normally present in detergents may be used. They are added in the form of an aqueous solution or in the form of a solution in an organic solvent to the polymer solution which is converted into the film or are added to a part-portion (washing preparation) of a detergent/cleaner in solid or liquid form. Examples of optical brighteners are derivatives of diamino-stilbenedisulfonic acid or alkali metal salts thereof. Suitable optical brighteners are, for example, salts of 4,4'-bis-(2-anilino-4-morpholino-1,3,5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro- 3-sulfostyryl)-diphenyl or 4-(4-chlorostyryl)4'-(2-sulfostyryl)-diphenyl, may also be present in the part-portions (washing preparations) of the laundry/dishwasher detergent portions according to the invention. Mixtures of the brighteners mentioned above may also be used.

Another preferred group of additives according to the invention are UV filters. UV filters are substances which are released in the washing process or in the subsequent fabric softening process in the wash liquor and which accumulate on the fibers where they then develop a UV-filtering effect. Suitable UV filters are, for example, the products commercially available under the name of Tinosorb from Ciba Speciality Chemicals.

Other possible additives preferred for special embodiments are surfactants which are capable in particular of influencing the solubility of the film and of controlling its wettability and also the formation of foam during dissolution of the film, foam inhibitors and bitter substances which can prevent children from accidentally swallowing the packs in question or parts thereof.

Another group of additives preferably used in accordance with the invention are dyes, more particularly water-soluble or water-dispersible dyes. Dyes of the type normally used to improve visual product appeal in detergents/cleaners are preferred. Such dyes are not difficult for the expert to choose, above all because they have high stability in storage, are not affected by the other ingredients of the washing preparations or by light and do not have any pronounced substantivity for textile fibers so as not to color them. The dyes are present in the laundry/dishwasher detergent portions according to the invention in quantities of less than 0.01% by weight.

Another class of additives which may be added to the laundry/dishwasher detergent portions according to the invention are polymers. Suitable polymers are, on the one hand, polymers which show co-builder properties during washing, dishwashing or cleaning, i.e. for example polyacrylic acids, modified polyacrylic acids and corresponding copolymers. Another group of polymers are polyvinyl pyrrolidone and other redeposition inhibitors, such as copolymers of polyvinyl pyrrolidone, cellulose ethers and the like. In another embodiment of the invention, the polymers may also be soil repellents. Soil repellents are polymers which are absorbed onto fibers or hard surfaces where they counteract resoiling. Relevant compounds of this type are known to the expert on detergents. They are polyesters of terephthalic acid and ethylene glycol partly modified with sulfonic acid groups.

Another group of additives are bleach catalysts, more particularly bleach catalysts for dishwasher detergents or laundry detergents. Complexes of manganese and cobalt, more particularly with nitrogen-containing ligands, are used for this purpose.

Another group of additives preferably used in accordance with the invention are silver corrosion inhibitors, i.e. any of various, mostly cyclic organic compounds which are also familiar to the expert and which contribute towards preventing silver-containing articles from tarnishing during the dishwashing process.

The laundry/dishwasher detergent portions may also contain components which have a positive effect on the removability of oil and fats from textiles by washing (so-called soil repellents) as further additives according to the invention. This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. Of these, the sulfonated derivatives of phthalic and terephthalic acid polymers are particularly preferred.

The detergent/cleaner portions may also contain soil repellents, i.e. polymers which are absorbed onto fibers or hard surfaces (for example onto china and glass) and which positively influence the removal of oils and fats from textile and thus counteract resoiling, as further additives according to the invention. This effect becomes particularly clear when a textile or a hard object (china, glass) which has already been repeatedly washed with a detergent according to the invention containing this oil- and fat-dissolving component is soiled. Preferred oil- and fat-dissolving components include, for example, nonionic cellulose ethers, such as methyl cellulose and methyl hydroxypropyl cellulose containing 15 to 30% by weight of methoxy groups and 1 to 15% by weight of hydroxypropoxy groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof. Of these, the sulfonated derivatives of phthalic acid and terephthalic acid polymers are particularly preferred.

Another group of additives are clear-rinse surfactants. These clear-rinse surfactants are present in liquid form and are widely described in the prior art. Their function is primarily to prevent lime stains and scale on the cleaned tableware. Clear-rinse surfactants are normally low-foaming nonionics.

All these additives are added to the laundry/dishwasher detergent portions according to the invention in quantities of up to at most 30% by weight and preferably 2 to 20% by weight. As already mentioned, they may also be added to a material of a water-soluble wrapper which comprises the, or one of the, washing preparation(s). In order to balance the formulation, the expert may also increase the weight of the plastic material for the wrapper in order thus to utilize the storage effect obtained in accordance with the invention by incorporating the additives in the wrapper(s) or additionally to keep the additives mentioned at least partly in the remaining detergent preparation. However, this is less preferred.

Perfumes are added to the laundry/dishwasher detergent portions according to the invention to improve the aesthetic impression created by the products and to provide the consumer not only with the required technical performance (fabric softening result) but also with a visually and sensorially "typical and unmistakable" product. Suitable perfume oils or perfumes include individual perfume compounds, for example synthetic products of the ester, ether, aldehyde, ketone, alcohol and hydrocarbon type. Perfume compounds of the ester type are, for example, benzyl acetate, phenoxyethyl isobutyrate, p-tert.butyl cyclohexyl acetate, linalyl acetate, dimethyl benzyl carbinyl acetate, phenyl ethyl acetate, linalyl benzoate, benzyl formate, ethyl methyl phenyl glycinate, allyl cyclohexyl propionate, styrallyl propionate and benzyl salicylate. The ethers include, for example, benzyl ethyl ether; the aldehydes include, for example, the linear alkanals containing 8 to 18 carbon atoms, citral, citronellal, citronellyloxyacetaldehyde, cyclamen aldehyde, hydroxycitronellal, lilial and bourgeonal.

The ketones include, for example, the ionones, a-isomethyl ionone and methyl cedryl ketone. The alcohols include anethol, citronellol, eugenol, geraniol, linalool, phenyl ethyl alcohol and terpineol. The hydrocarbons include, above all, the terpenes, such as limonene and pinene. However, mixtures of various perfumes which together produce an attractive perfume note are preferably used. Perfume oils such as these may also contain natural perfume mixtures obtainable from vegetable sources, for example pine, citrus, jasmine, patchouli, rose or ylang-ylang oil. Also suitable are clary oil, camomile oil, clove oil, melissa oil, mint oil, cinnamon leaf oil, lime blossom oil, juniper berry oil, vetiver oil, olibanum oil, galbanum oil and labdanum oil and orange blossom oil, neroli oil, orange peel oil and sandalwood oil.

The perfume content is normally up to 2% by weight, based on the laundry/dishwasher detergent portion as a whole.

The perfumes may be directly incorporated in the active washing preparations, although it can also be of advantage to apply the perfumes to supports which strengthen the adherence of the perfume to the washing and which provide the textiles with a long-lasting perfume through a slower release of the perfume. Suitable support materials are, for example, cyclodextrins, the cyclodextrin/perfume complexes optionally being coated with other auxiliaries.

Basically, the perfumes may be present in each of the part-portions (washing preparations) of the laundry/dishwasher detergent portions according to the invention. In one particularly preferred embodiment, however, they are present in a detergent in a laundry detergent part-portion intended for the after-wash cycle or fabric-softening cycle or in a cleaning composition, particularly a dishwashing detergent, in a part-portion thereof intended for the final rinse or clear rinse cycle. According to the invention, therefore, they have to be surrounded by a material which only dissolves in water under the conditions (more particularly at the temperature) of the after-wash or final rinse cycle, but which is insoluble in water under the conditions (more particularly at the temperature) of the preceding wash cycles, more particularly a corresponding film or capsule. According to the invention, this is possible for example with a multi-compartment bag of films differing in their water solubility.

The laundry/dishwasher detergent portions according to the invention may be present in a wide variety of forms. These various forms are dependent on the particular components used, more particularly by the washing preparations, but may also be freely selected within certain limits.

Thus, numerous washing preparations are present in the form of powders or powder mixtures so that laundry/dishwasher detergent portions according to the invention may be made up as combinations of powder-form components, for example as combinations of powder-form components in film bags with several compartments or layers or as combinations of powder-form components in capsules. In another preferred embodiment of the invention, the solid, for example powder-form, components may be present as granules or beads and—like the powders—may be packed in the form of granules or beads in film bags with several layers or compartments or in capsules and may then be directly used in this form for washing or cleaning.

In another preferred embodiment of the invention, the laundry/dishwasher detergent portions may also be present in the form of solids compressed to form shaped bodies of any form; such shaped bodies (such as tablets, blocks, briquettes, rings or the like) are known from the prior art and may also be used within the scope of the present invention. More particularly, shaped bodies of the type in question may also have cavities, depressions, indentations or the like for accommodating individual washing substances. Shaped bodies in combination with powders, in combination with liquids (for example in a wrapper of a water-soluble material according to the invention) or in combination with a washing preparation embedded in a fusible matrix are of course also within the scope of the present invention.

Besides the laundry/dishwasher detergent portions described in detail in the foregoing, the present invention also relates to a process for the production of laundry/dishwasher detergent portions comprising first and second measured quantities of washing preparations as described in the foregoing, comprising the steps of (a) making ready at least one material which dissolves in water at a certain temperature and (b) wrapping at least one of the first and second measured quantities of washing preparations in this material to form a laundry/dishwasher detergent portion.

The process preferably comprises the steps of (a) making ready at least one material which dissolves in water at a temperature above a first temperature;

(b) wrapping the measured quantity of a second washing preparation active in aqueous phase at a temperature above the first temperature in that material to form a laundry/dishwasher detergent portion and (c) combining a measured quantity of a first washing preparation and optionally a measured quantity of a third washing preparation with the laundry/dishwasher detergent part-portion produced in step (b) to form a laundry/dishwasher detergent portion.

In preferred embodiments of this process, the measured quantity of a first washing preparation and optionally the measured quantity of a third washing preparation are each wrapped in a water-soluble material which dissolves in water at a lower or higher temperature than the material surrounding the second washing preparation.

According to the invention, materials of similar chemical composition which differ in their solubility in water are preferably used as the second water-soluble material and optionally at the first and third water-soluble materials which surround the second measured quantity and optionally the first and the third measured quantities of washing preparations. As already explained in detail in the foregoing, water-soluble polymer films, preferably polyvinyl alcohol films and more preferably polyvinyl alcohol films which dissolve in water at the temperatures of the particular step of the washing or cleaning cycle are used as the second water-soluble material and optionally as the first and third water-soluble materials in a particularly preferred embodiment of the invention. With films such as these, the solubility of the materials in water can be adjusted to meet particular requirements so that, in a washing or dishwashing process, the first, second and optionally third measured quantities of washing preparations only pass into the wash liquor in that cycle of the washing or dishwashing program in which they develop their optimal effects.

Finally, the present invention also relates to a washing process, more particularly a machine washing process, wherein a laundry detergent portion as described in detail in the foregoing is placed in a washing machine and the laundry detergent part-portion is released into the wash liquor by addition of water and adjustment of the temperature to the temperature at which the water-soluble material surrounding the particular laundry detergent part-portion dissolves while the other laundry detergent part-portions are protected against contact with the wash liquor and are released at other temperatures, and to a cleaning process, more particularly a machine dishwashing process, wherein a dishwasher detergent part-portion as described in detail in the foregoing is placed in a dishwashing machine and the dishwasher detergent part-portion is released into the wash liquor by addition of water and adjustment of the temperature to the temperature at which the water-soluble material surrounding the particular dishwasher detergent part-portion dissolves while the other dishwasher detergent part-portions are protected against contact with the wash liquor and are released at other temperatures. In order to achieve this, it is preferred in accordance with the invention to place the dishwasher detergent portion described in detail in the foregoing in the dispensing compartment of a dishwasher or in the interior of a dishwasher where water circulates.

The following Examples are intended to illustrate the invention without limiting it in any way.

EXAMPLES 1 to 4 and COMPARISON EXAMPLE

The performance of various dishwasher detergents portions according to the invention in the cleaning of tableware was evaluated by a standard method. Standard tableware soils (100 g frozen cube) as listed in Table 1 below were washed in a Miele G 593 SC dishwasher (main wash cycle, universal program, 55° C.) using water with a hardness of 16° d.

TABLE 1

| No. | Soil |
|---|---|
| 1 | Tea stains |
| 2 | Milk |
| 3 | Minced meat (burnt-on) |
| 4 | Minced meat (baked-on) (DIN) |
| 5 | Soft egg (removal) |
| 6 | Egg + milk |
| 7 | Oats (DIN) |
| 8 | Starch mixture (removal) |

The dishwasher detergent preparation was divided up into component groups or individual components K0 to K4 according to the quantity distribution shown in Table 2.

TABLE 2

| Component | % by weight | Quantity [g] K0 | K1 | K2 | K3 | K4 |
|---|---|---|---|---|---|---|
| Sodium tripolyphosphate | 55.0 | 13.8 | — | — | — | — |
| Calc. Soda | 22.6 | 5.7 | — | — | — | — |
| Silicate | 5.0 | 1.3 | — | — | — | — |
| Perborate | 10.0 | — | 2.5 | — | — | — |
| TAED | 2.0 | — | — | — | 0.5 | — |
| Amylase | 2.0 | — | — | 0.5 | — | — |
| Protease | 1.4 | — | — | 0.4 | — | — |
| $C_{12/14}$ fatty alcohol carboxylate ($EO_5/PO_4$) | 2.0 | — | — | — | — | 0.5 |

Note:

The percentages by weight are based on the total weight of the dishwasher detergent components. "K0", "K1", "K2" etc. denote the number of the dishwasher detergent component or group of dishwasher detergent components in Table 3.

The dishwasher detergent components K0 to K4 listed in Table 2 were welded into cold-water-soluble PVAL film (c.w.s.), PVAL film soluble in water at 40° C. (40) and PVAL film soluble in water at 60° C. (60)

in the manner illustrated in Table 3. The PVAL films were SOLUBLON films of the KA 30 (c.w.s), BP (40) and LA (60) types obtainable from Syntana Handelsgesellschaft E. Harke GmbH & Co.

All the dishwasher detergent part-portions were combined to form a dishwasher detergent portion and used in the main wash cycle with a temperature profile of 15° C. to 60° C. A dishwasher detergent portion of the same components as in Table 2 (total weight 25.2 g, i.e. the same quantities of all components), which was not packed in a PVAL film, was used for comparison.

The results of Examples 1 to 4 and the Comparison Example (comp.) shown in Table 3 below are the averages of six measurements of the same soil. The results were based on the following evaluation scale:

1. Tea stains: evaluation scale 1 to 10 (1=hardly removed, 10=completely removed)
2. Milk: see 1.
3. Minced meat (burnt-on): see 1.
4. Minced meat (baked-on) (DIN); see 1.
5. Soft egg (removal): removal of the soil in %
6. Egg +milk: see 1.
7. Oats (DIN); see 1.
8. Starch mixture (removal): removal of the soil in %.

TABLE 3

| Ex. | Film | Component | Soil/evaluation of cleaning performance 1. | 2. | 3. | 4. | 5.* | 6. | 7 | 8.* |
|---|---|---|---|---|---|---|---|---|---|---|
| 1 | c.w.s | K0 | 6.5 | 7.3 | 8.5 | 9.2 | 70 | 10.0 | 8.0 | 95 |
| | c.w.s | K1 | | | | | | | | |
| | 40 | K2 | | | | | | | | |
| | 40 | K3 | | | | | | | | |
| | 60 | — | | | | | | | | |
| 2 | c.w.s. | K0 | 7.2 | 8.0 | 8.0 | 9.2 | 61 | 10.0 | 8.5 | 99 |
| | c.w.s. | K1 | | | | | | | | |
| | 40 | K3 | | | | | | | | |
| | 40 | — | | | | | | | | |
| | 60 | k2 | | | | | | | | |
| 3 | c.w.s. | K0 | 5.8 | 9.0 | 7.0 | 9.2 | 84 | 10.0 | 8.2 | 98 |
| | c.w.s. | K2 | | | | | | | | |
| | 40 | K1 | | | | | | | | |
| | 40 | K3 | | | | | | | | |
| | 60 | — | | | | | | | | |
| 4 | c.w.s. | K0 | 6.8 | 7.8 | 7.5 | 9.2 | 83 | 10.0 | 8.0 | 96 |
| | c.w.s. | K2 | | | | | | | | |
| | 40 | K1 | | | | | | | | |
| | 40 | — | | | | | | | | |
| | 60 | K3 | | | | | | | | |
| Comp. | — | — | 6.3 | 8.5 | 7.7 | 9.2 | 86 | 10.0 | 7.2 | 98 |

Note: (*): figures signify the removal of soil in "%".

The results set out in Table 3 show that, with most soils, a favorable cleaning result comparable with the prior art can be obtained irrespective of the temperature-related sequence in which the washing preparations had to be added. In some instances (soil 7), the results obtained were even better in every case.

Where the tableware was soiled with soft egg, the result was significantly better in every case where the enzyme-containing preparation (component K2) passed into the aqueous phase before the bleaching agent (Examples 3 and 4), for example because the bleaching agent was wrapped in a water-soluble film which had not become soluble in water at the temperature at which the enzyme preparation passed into the aqueous phase.

What is claimed is:

1. A laundry or dishwasher detergent portion, comprising a first measured quantity of a washing preparation that passes into an aqueous phase at a temperature below or equal to a first temperature and that is surrounded by a first water-soluble material that enables the first measured quantity of washing preparation to pass into an aqueous phase at a temperature below or equal to the first temperature;

a second measured quantity of a washing preparation that passes into an aqueous phase at a temperature below or equal to a second temperature that is above the first temperature; and a second water-soluble material that surrounds the second measured quantity of a washing preparation and which dissolves in water at a temperature above the first temperature, said first, second, and any additional measured quantities of washing preparation comprising the laundry or dishwasher detergent portion being in joined spatial combination to form the laundry or dishwasher detergent portion as a single dose sufficient for a washing or cleaning process in an aqueous environment.

2. The laundry or dishwasher detergent portion of claim 1, comprising a third measured quantity of a washing preparation which passes into an aqueous phase at a temperature above the second temperature, wherein the material surrounding the second measured quantity of a washing preparation is a water-soluble pack.

3. The laundry or dishwasher detergent portion of claim 1, wherein the material surrounding the second measured quantity of a washing preparation is a water-soluble pack.

4. The laundry or dishwasher detergent portion of claim 3, wherein the water-soluble pack comprises a water-soluble polymer film.

5. The laundry or dishwasher detergent portion of claim 4, wherein the polymer film comprises polyvinyl alcohol.

6. The laundry or dishwasher detergent portion of claim 1, wherein the film dissolves in water at temperatures above 30° C.

7. The laundry or dishwasher detergent portion of claim 1, wherein the material surrounding the second measured quantity of a washing preparation is a water-soluble capsule.

8. The laundry or dishwasher detergent portion of claim 7, wherein the water-soluble capsule comprises gelatine.

9. The laundry or dishwasher detergent portion of claim 1, wherein the material surrounding the second measured quantity of a washing preparation is a coating.

10. The laundry or dishwasher detergent portion of claim 9, wherein the coating comprises one or more waxes.

11. The laundry or dishwasher detergent portion of claim 10, wherein the one or more waxes melt at a temperature above 30° C. but do not dissolve in water at a temperature below 30° C.

12. The laundry or dishwasher detergent portion of claim 1, wherein the material surrounding the second measured quantity of a washing preparation is a material that does not dissolve in cold water.

13. The laundry or dishwasher detergent portion of claim 12, wherein the material surrounding the second measured quantity of a washing preparation does not dissolve in water at a temperature below or equal to the first temperature.

14. The laundry or dishwasher detergent portion of claim 2, wherein the third measured quantity of a washing preparation is surrounded by a third water-soluble material that dissolves in water at a temperature above the second temperature.

15. The laundry or dishwasher detergent portion of claim 1, wherein the first and the second measured quantities of washing preparations are present in the form of interconnected part-portion packs, each quantity separately surrounded by their respective water-soluble materials.

16. The laundry or dishwasher detergent portion of claim 14, wherein the first, the second, and the third measured quantities of washing preparations are present in the form of interconnected part-portion packs, each quantity separately surrounded by their respective water-soluble materials.

17. The laundry or dishwasher detergent portion of claim 1, wherein said first water-soluble material also surrounds the second measured quantity of washing preparation surrounded by the second water-soluble material, said portion thereby having a sandwich-like or shell/core form.

18. The laundry or dishwasher detergent portion of claim 2, wherein the second water-soluble material also surrounds the third measured quantity of washing preparation surrounded by the third water-soluble material, and said first water-soluble material also surrounds the second measured quantity of washing preparation surrounded by the second water-soluble material and surrounding the third measured quantity of washing preparation, said portion thereby having a sandwich-like form or shell/core form.

19. The laundry or dishwasher detergent portion of claim 1, wherein the first and second measured quantities of washing preparations are surrounded by a material that dissolves in water at a temperature below or equal to the first temperature.

20. The laundry or dishwasher detergent portion of claim 2, wherein the first, second, and third measured quantities of washing preparations are surrounded by a material that dissolves in water at a temperature below or equal to the first temperature.

21. The laundry or dishwasher detergent portion of claim 19, wherein the second measured quantity of washing preparation is in a form that retards its passing into an aqueous phase at a temperature below or equal to the first temperature.

22. The laundry or dishwasher detergent portion of claim 21, wherein the second measured quantity of washing preparation is surrounded by a material that does not dissolve in water at a temperature below or equal to the first temperature.

23. The laundry or dishwasher detergent portion of claim 20, wherein the second and third measured quantities of washing preparation are in a form that retards their passing into an aqueous phase at a temperature below or equal to the first temperature.

24. The laundry or dishwasher detergent portion of claim 23, wherein the second and third measured quantities of washing preparation are each surrounded by a material that does not dissolve in water at a temperature below or equal to the first temperature.

25. The laundry or dishwasher detergent portion of claim 19, wherein all or at least some of the first and second measured quantities of washing preparations pass into the aqueous phase at the same temperatures or at successive temperatures of a wash or cleaning cycle.

26. The laundry or dishwasher detergent portion of claim 20, wherein all or at least some of the first, second, and third measured quantities of washing preparations pass into the aqueous phase at the same temperatures or at successive temperatures of a wash or cleaning cycle.

27. The laundry or dishwasher detergent portion of claim 1, wherein all water-soluble materials surrounding the measured quantity or quantities of washing preparations are materials of similar chemical composition that differ in their solubility in water.

28. The laundry or dishwasher detergent portion of claim 27, wherein the second measured quantity of washing preparation, and optionally all other measured quantities of washing preparation, are surrounded by one or more water-soluble material comprising a water-soluble polymer film.

29. The laundry or dishwasher detergent portion of claim 28, wherein the water-soluble polymer film comprises polyvinyl alcohol.

30. The laundry or dishwasher detergent portion of claim 29, wherein the water-soluble materials each dissolve in water at a temperature corresponding to a particular step of a machine wash or cleaning cycle.

31. The laundry or dishwasher detergent portion of claim 1, wherein each measured quantity of washing preparation independently of the other or others is in tablet, powder, gel, or liquid form.

32. The laundry or dishwasher detergent portion of claim 1, wherein the first measured quantity of washing preparation is for a pre-rinse or pre-wash cycle and the second measured quantity of a washing preparation is for a main cleaning or main wash cycle.

33. The laundry or dishwasher detergent portion of claim 1, wherein the first measured quantity of a washing preparation is for a pre-rinse or pre-wash cycle, the second measured quantity of a washing preparation is for a main cleaning or main wash cycle, and further comprising a third measured quantity of a washing preparation for a clear-rinse or final rinse cycle.

34. The laundry or dishwasher detergent portion of claim 1, wherein the first measured quantity of a washing preparation is for a main cleaning or main wash cycle and the second measured quantity of a washing preparation is for a clear-rinse or final rinse cycle.

35. The laundry or dishwasher detergent portion of claim 1, wherein:

(a) the first and second measured quantities, and optionally additional quantities, of washing preparations are for a pre-wash or pre-rinse cycle, a main wash or main cleaning cycle, or a final rinse or clear-rinse cycle, the detergent portion optionally further comprising (b) one or more additional measured quantities of one or more washing preparations for one or more wash or cleaning cycles in which the measured quantities of washing preparation(s) in (a) do not pass into an aqueous phase.

36. A laundry detergent portion according to claim 1, comprising:

(a) optionally a measured quantity of a pre-wash composition optionally surrounded by the first water-soluble material;

(b) a measured quantity of a laundry detergent surrounded by the second water-soluble material; and optionally (c) a measured quantity of an after-wash composition optionally surrounded by a third water-soluble material.

37. The laundry detergent of claim 36, wherein:

(a) the first water-soluble material present dissolves in water below the maximum temperature of the cold wash cycle of a washing machine;

(b) the second water-soluble material dissolves in water above the maximum temperature of the cold wash cycle and below the maximum temperature of the main wash cycle of a washing machine; and (c) the third water-soluble material optionally present dissolves in water at the temperature of the final wash cycle of a washing machine.

38. The laundry detergent portion of claim 37, wherein the maximum temperature of the cold wash cycle is 20° C., the temperature of the main wash cycle is greater than 20° C. to 90° C., and the temperature of the final wash cycle is about 30° C.

39. A dishwasher detergent portion according to claim 1, comprising (a) a measured quantity of a pre-cleaning composition surrounded by the first water-soluble material;

(b) a measured quantity of a dishwasher detergent surrounded by the second water-soluble material; and optionally (c) a measured quantity of a rinse aid optionally surrounded by a third water-soluble material.

40. The dishwasher detergent portion of claim 39, wherein (a) the first water-soluble material dissolves in water below the maximum temperature or the cold wash cycle of a dishwashing machine;

(b) the second water-soluble material dissolves in water above the maximum temperature of the cold wash cycle and below the maximum temperature of the main wash cycle of a dishwashing machine and (c) the third water-soluble material optionally present dissolves in water at the temperature of the clear-rinse cycle of a dishwashing machine.

41. The dishwasher detergent portion of claim 39, wherein the measured quantity of detergent surrounded by the second water-soluble material comprises an aftertreatment additive that passes into an aqueous phase at temperatures above 50° C.

42. The dishwasher detergent portion of claim 41, wherein the aftertreatment additive passes into an aqueous phase at temperatures above 55° C.

43. The dishwasher detergent of claim 41, wherein the aftertreatment additive comprises a temperature-sensitive coating, dissolving in water at a certain temperature that allow the additive to pass into an aqueous phase at temperatures above 50° C.

44. The dishwasher detergent portion of claim 41, wherein the aftertreatment additive has a tablet form that prevents it from passing through a dishwashing machine liquor pump filter.

45. The dishwasher detergent portion of claim 39, wherein the first measured quantity of pre-cleaning composition surrounded by the first water-soluble material comprises a pretreatment composition for machine dishwashing.

46. The dishwasher detergent portion of claim 45, wherein the pretreatment composition for machine dishwashing comprises one or more components selected from the group consisting of an alkalizing agent, a cold-water-soluble enzyme, an acidifying agent, an alkaline chlorine source, a bleaching agent, a surfactant preparation, an acidic bleaching composition, and an antibacterial agent.

47. The dishwasher detergent portion of claim 45, wherein the pretreatment composition for machine dishwashing comprises a cold-water-soluble enzyme.

48. The dishwasher detergent portion of claim 39, wherein the dishwasher detergent or rinse aid comprise one or more rinse aids and/or perfumes.

49. The dishwasher detergent portion of claim 40, wherein the maximum temperature of the main wash cycle of the dishwashing machine is 45° C.

50. The dishwasher detergent portion of claim 49, wherein the maximum temperature of the main wash cycle of t e dishwashing machine is 30° C.

51. The dishwasher detergent portion of claim 40, wherein the maximum temperature of the cold wash cycle of the dishwashing machine is 45° C.

52. The dishwasher detergent portion of claim 51, wherein the maximum temperature of the cold wash cycle of the dishwashing machine is 30° C.

53. A method of producing the laundry or dishwasher detergent portion of claim 1, comprising the steps of:

(a) surrounding the first measured quantity of a washing preparation with the first water-soluble material;

(b) surrounding the second measured quantity of washing preparation in the second water-soluble material; and (c) combining the first and second measured quantities (a) and (b) to form the laundry or dishwasher detergent portion.

54. The method of claim 53 further comprising the steps of:

(a) forming a third water-soluble material that dissolves in water at a temperature above the second temperature;

(b) surrounding a third measured quantity of washing preparation, said washing preparation being active in an aqueous phase at a temperature above the second temperature, in the material formed in (a); and (c) combining the third measured quantity of washing preparation with the first and second washing preparations to form the laundry or dishwasher detergent portion.

55. The method of claim 53, wherein the first measured quantity of washing preparation and the third measured quantity of washing preparation are respectively wrapped in a water-soluble material that dissolves in water at a lower and higher temperature than the material surrounding the second washing preparation.

56. The method of claim 55, wherein the water-soluble materials surrounding the first, second, and optional third washing preparations each have a similar chemical composition and differing solubility.

57. The method of claim 54, wherein the at least one material that dissolves in water at a temperature above the first temperature comprises a water-soluble polymer film.

58. The method of claim 57, wherein the water-soluble polymer film comprises polyvinyl alcohol.

59. The method of claim 57, wherein each water-soluble material dissolves in water at a temperature corresponding to a particular step of a wash or cleaning cycle.

60. A machine washing process, comprising the steps of placing the laundry detergent portion of claim 1 in a washing machine and forming a wash liquor in the machine by adding water to the laundry detergent portion and adjusting the wash-liquor temperature to the temperature at which the water-soluble material surrounding the second washing preparation dissolves, whereby the second washing preparation passes into the wash liquor while the other washing preparation or preparations pass into the wash liquor at a temperature other than the temperature at which the water-soluble material surrounding the second washing preparation dissolves.

61. A machine dishwashing process, comprising the steps of placing the dishwasher detergent portion of claim 1 in a dishwashing machine and forming a wash liquor in the machine by adding water to the dishwasher detergent portion and adjusting the wash-liquor temperature to the temperature at which the water-soluble material surrounding the second washing preparation dissolves, whereby the second washing preparation passes into the wash liquor while the other washing preparation or preparations pass into the wash liquor at a temperature other than the temperature at which the water-soluble material surrounding the second washing preparation dissolves.

* * * * *

UNITED STATES PATENT AND TRADEMARK OFFICE

CERTIFICATE OF CORRECTION

PATENT NO. : 6,448,212 B1
DATED : September 10, 2002
INVENTOR(S) : Holderbaum et al.

It is certified that error appears in the above-identified patent and that said Letters Patent is hereby corrected as shown below:

Column 37,
Lines 29-31, delete “, wherein the material surrounding the second measured quantity of a washing preparation is a water-soluble pack”.

Column 40,
Line 22, delete “or”, and insert therefor -- of --.
Line 41, after “coating,”, insert -- a substance melting at a certain temperature or a coating --.

Column 41,
Line 2, delete “t e”, and insert -- the --.

Signed and Sealed this

Thirtieth Day of September, 2003

JAMES E. ROGAN
*Director of the United States Patent and Trademark Office*